US008178808B2

(12) United States Patent
Strittmatter

(10) Patent No.: US 8,178,808 B2
(45) Date of Patent: May 15, 2012

(54) BREATHABLE SEALED DOME SWITCH ASSEMBLY

(75) Inventor: Patrick Clement Strittmatter, Irving, TX (US)

(73) Assignee: Research in Motion Limited, Waterloo (CA)

( * ) Notice: Subject to any disclaimer, the term of this patent is extended or adjusted under 35 U.S.C. 154(b) by 264 days.

(21) Appl. No.: 12/710,457

(22) Filed: Feb. 23, 2010

(65) Prior Publication Data

US 2010/0213044 A1 Aug. 26, 2010

Related U.S. Application Data

(60) Provisional application No. 61/154,905, filed on Feb. 24, 2009.

(51) Int. Cl.
*H01H 13/70* (2006.01)

(52) U.S. Cl. ..... 200/515

(58) Field of Classification Search ..... 200/330, 200/515

See application file for complete search history.

(56) References Cited

U.S. PATENT DOCUMENTS

| | | | | |
|---|---|---|---|---|
| 4,046,975 | A | 9/1977 | Seeger, Jr. | |
| 4,066,855 | A | 1/1978 | Zenk | |
| 4,249,044 | A | 2/1981 | Larson | |
| 4,365,408 | A * | 12/1982 | Ditzig | 29/622 |
| 4,485,279 | A | 11/1984 | Nakamura | |
| 4,524,254 | A | 6/1985 | Yoshida et al. | |
| 4,636,598 | A | 1/1987 | Suzuki | |
| 4,800,244 | A | 1/1989 | Suzuki | |
| 4,916,275 | A * | 4/1990 | Almond | 200/516 |
| 5,308,939 | A | 5/1994 | Sasaki | |
| 5,823,325 | A * | 10/1998 | Lin | 200/344 |
| 5,874,700 | A | 2/1999 | Hochgesang | |
| 5,895,900 | A | 4/1999 | Okada et al. | |
| 5,969,320 | A | 10/1999 | Leeper et al. | |
| 6,495,780 | B1 * | 12/2002 | Tucci et al. | 200/302.1 |
| 6,710,274 | B2 * | 3/2004 | Whetzel et al. | 200/330 |
| 6,794,590 | B2 | 9/2004 | Federspiel | |
| 7,759,591 | B2 * | 7/2010 | Kim et al. | 200/181 |
| 2005/0121299 | A1 | 6/2005 | Ide et al. | |
| 2006/0198086 | A1 | 9/2006 | Wang | |

FOREIGN PATENT DOCUMENTS

WO WO 01/86676 A1 11/2001

OTHER PUBLICATIONS

Search Report from corresponding European Application No. 10154368.4; search completed May 7, 2010.

* cited by examiner

*Primary Examiner* — Briggitte R Hammond
(74) *Attorney, Agent, or Firm* — Novak Druce + Quigg LLP

(57) ABSTRACT

A sealed dome switch assembly is provided to allow air to flow between the interior and the exterior of the dome switch during the collapse and recovery of the resilient dome shell. The sealed dome switch assembly comprises at least one vent leading between the interior space and the exterior space of the sealed dome switch, wherein the vent is covered by a membrane that is permeable to air and resilient to liquid (e.g. water) and small particles (e.g. dirt). A vent may also be used to network the interiors of a plurality of sealed dome switches to at least one exterior entranceway that is covered by the membrane.

13 Claims, 18 Drawing Sheets

(a)

(b)

(a)

(b)

(a)

(b)

BREATHABLE SEALED DOME SWITCH ASSEMBLY

This application claims priority from U.S. provisional application No. 61/154,905 filed on Feb. 24, 2009, the contents of which are incorporated herein by reference.

TECHNICAL FIELD

The following relates generally to switches, and more particularly to dome switches.

DESCRIPTION OF THE RELATED ART

In electronic devices, such as mobile devices, push keys may be employed for various applications including, for example, a keyboard, a camera button, an activate call button and a menu button. In some push key assemblies, the key may interact with a switch below and transfer a pushing force to close the switch, thereby allowing an electrical circuit to be completed. These keys are typically located on or towards the exterior of the device allowing a user to interact with the keys.

The location of the key and switch assemblies may expose a switch to environmental elements, such as water and dirt. These environmental elements may interfere with the functionality of the key and switch assemblies. In some instances, the environmental elements may affect the completion of an electrical circuit. For example, dust may be lodged between two electrically conducting surfaces, which can prevent a proper electrical connection. In another example, water may interact with two isolated electrically conducting surfaces, which may lead to an inadvertent short circuiting.

BRIEF DESCRIPTION OF THE DRAWINGS

Embodiments will now be described by way of example only with reference to the appended drawings wherein:

FIG. 4(*b*) is another cross-sectional elevation view of the key and dome switch in an actuated position.

FIG. 5(*b*) is a plan view of the dome switch in isolation.

FIG. 7(*b*) is a plan view of a metal dome switch assembly.

DETAILED DESCRIPTION

Figure 2:
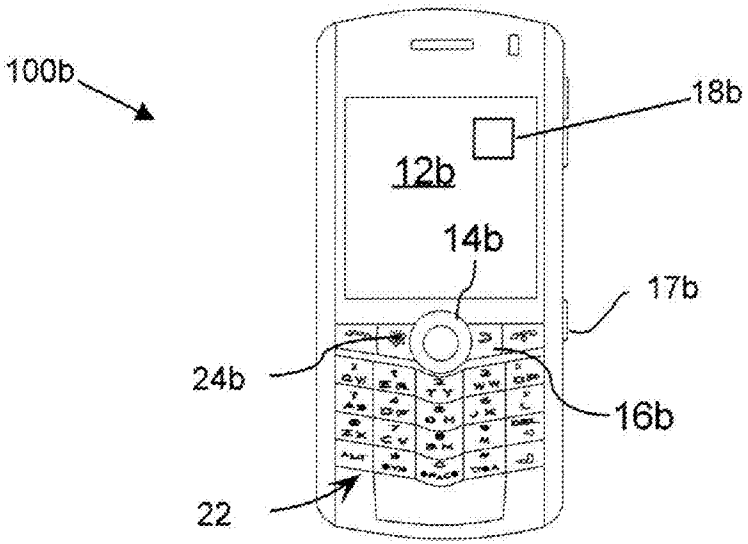
FIG. 2 is a schematic diagram of another mobile device and a display screen therefor.

It will be appreciated that for simplicity and clarity of illustration, where considered appropriate, reference numerals may be repeated among the figures to indicate corresponding or analogous elements. In addition, numerous specific details are set forth in order to provide a thorough understanding of the embodiments described herein. However, it will be understood by those of ordinary skill in the art that the embodiments described herein may be practiced without these specific details. In other instances, well-known methods, procedures and components have not been described in detail so as not to obscure the embodiments described herein.

Also, the description is not to be considered as limiting the scope of the embodiments described herein.

In the field of electronic devices, push keys may be used to activate functions within the device. The operation of input devices, for example push keys, may depend on the type of electronic device and the applications of the device.

Examples of applicable electronic devices include pagers, cellular phones, cellular smart-phones, wireless organizers, personal digital assistants, computers, laptops, handheld wireless communication devices, wirelessly enabled notebook computers, cameras and the like. Such devices will hereinafter be commonly referred to as "mobile devices" for the sake of clarity. It will however be appreciated that the principles described herein are also suitable to other devices, e.g. "non-mobile" devices.

In a typical embodiment, the mobile device is a two-way communication device with advanced data communication capabilities including the capability to communicate with other mobile devices or computer systems through a network of transceiver stations. The mobile device may also have the capability to allow voice communication. Depending on the functionality provided by the mobile device, it may be referred to as a data messaging device, a two-way pager, a cellular telephone with data messaging capabilities, a wireless Internet appliance, or a data communication device (with or without telephony capabilities).

Figure 1:
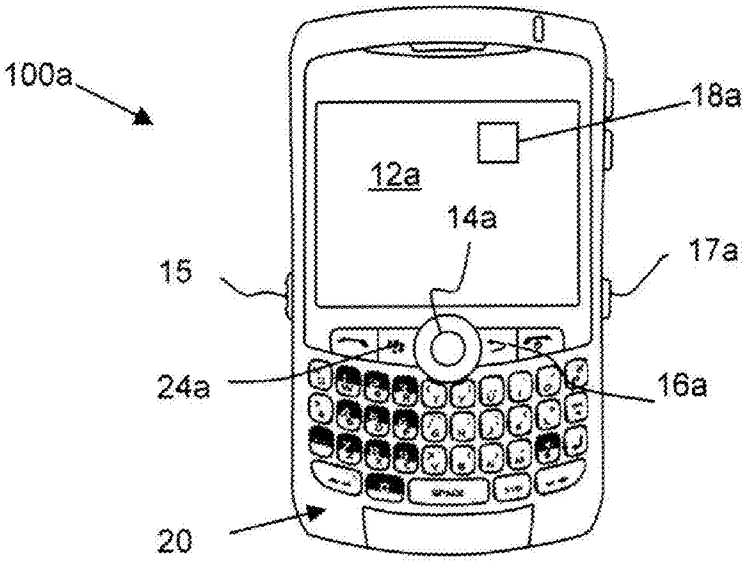
FIG. 1 is a schematic diagram of a mobile device and a display screen therefor.

Referring to FIGS. 1 and 2, one embodiment of a mobile device 100*a* is shown in FIG. 1, and another embodiment of a mobile device 100*b* is shown in FIG. 2. It will be appreciated that the numeral "100" will hereinafter refer to any mobile device 100, including the embodiments 100*a* and 100*b*, those embodiments enumerated above or otherwise. It will also be appreciated that a similar numbering convention may be used for other general features common between FIGS. 1 and 2 such as a display 12, a positioning device 14, a cancel or escape button 16, a camera button 17, and a menu or option button 24.

The mobile device 100*a* shown in FIG. 1 comprises a display 12*a* and the cursor or view positioning device 14 shown in this embodiment is a trackball 14*a*. Positioning device 14 may serve as another input member and is both rotational to provide selection inputs to the main processor 102 (see FIG. 3) and can also be pressed in a direction generally toward housing to provide another selection input to the processor 102. Trackball 14*a* permits multi-directional positioning of the selection cursor 18*a* such that the selection cursor 18*a* can be moved in an upward direction, in a downward direction and, if desired and/or permitted, in any diagonal direction. The trackball 14*a* is in this example situated on the front face of a housing for mobile device 100*a* as shown in FIG. 1 to enable a user to manoeuvre the trackball 14*a* while holding the mobile device 100*a* in one hand. The trackball 14*a* may serve as another input member (in addition to a directional or positioning member) to provide selection inputs to the processor 102 and can preferably be pressed in a direction towards the housing of the mobile device 100*b* to provide such a selection input.

The display 12 may include a selection cursor 18*a* that depicts generally where the next input or selection will be received. The selection cursor 18*a* may comprise a box, alteration of an icon or any combination of features that enable the user to identify the currently chosen icon or item. The mobile device 100*a* in FIG. 1 also comprises a programmable convenience button 15 to activate a selected application such as, for example, a calendar or calculator. Further, mobile device 100*a* includes an escape or cancel button 16*a*, a camera button 17*a*, a menu or option button 24*a* and a keyboard 20. The camera button 17 is able to activate photo-capturing functions when pressed preferably in the direction towards the housing. The menu or option button 24 loads a menu or list of options on display 12*a* when pressed. In this example, the escape or cancel button 16*a*, the menu option button 24*a*, and keyboard 20 are disposed on the front face of the mobile device housing, while the convenience button 15 and camera button 17*a* are disposed at the side of the housing. This button placement enables a user to operate these buttons while holding the mobile device 100 in one hand. The keyboard 20 is, in this embodiment, a standard QWERTY keyboard.

The mobile device 100*b* shown in FIG. 2 comprises a display 12*b* and the positioning device 14 in this embodiment comprises a trackball 14*b*. The mobile device 100*b* also comprises a menu or option button 24*b*, a cancel or escape button 16*b*, and a camera button 17*b*. The mobile device 100*b* as illustrated in FIG. 2, comprises a reduced QWERTY keyboard 22. In this embodiment, the keyboard 22, positioning device 14*b*, escape button 16*b* and menu button 24*b* are disposed on a front face of a mobile device housing. The reduced QWERTY keyboard 22 comprises a plurality of multi-functional keys and corresponding indicia including keys associated with alphabetic characters corresponding to a QWERTY array of letters A to Z and an overlaid numeric phone key arrangement.

It will be appreciated that for the mobile device 100, a wide range of one or more positioning or cursor/view positioning mechanisms such as a touch pad, a positioning wheel, a joystick button, a mouse, a touchscreen, a set of arrow keys, a tablet, an accelerometer (for sensing orientation and/or movements of the mobile device 100 etc.), or other whether presently known or unknown may be employed. Similarly, any variation of keyboard 20, 22 may be used. It will also be appreciated that the mobile devices 100 shown in FIGS. 1 and 2 are for illustrative purposes only and various other mobile devices 100 are equally applicable to the following examples. For example, other mobile devices 100 may include the trackball 14*b*, escape button 16*b* and menu or option button 24 similar to that shown in FIG. 2 only with a full or standard keyboard of any type. Other buttons may also be disposed on the mobile device housing such as colour coded "Answer" and "Ignore" buttons to be used in telephonic communications. In another example, the display 12 may itself be touch sensitive thus itself providing an input mechanism in addition to display capabilities.

Figure 3:
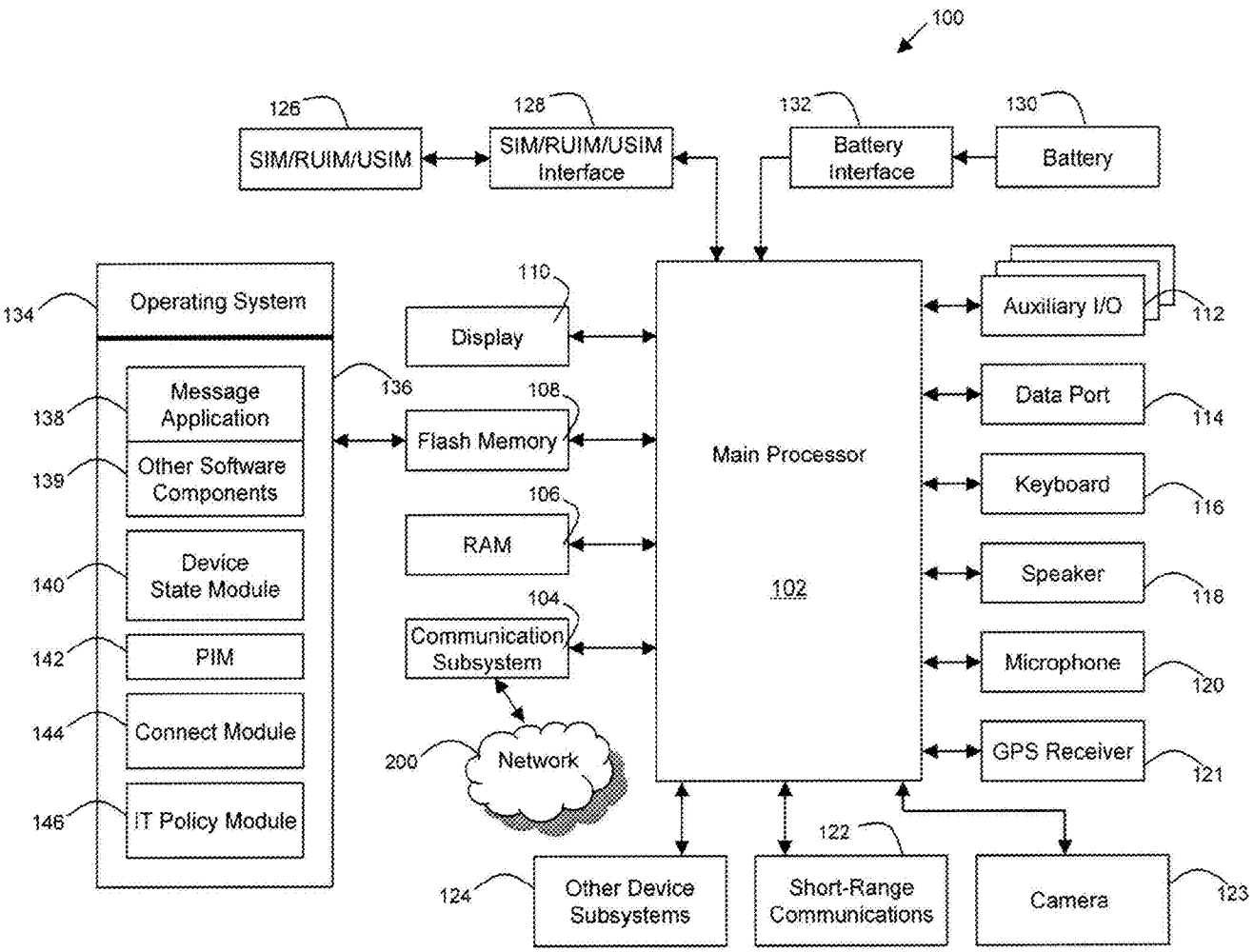
FIG. 3 is a block diagram of an exemplary embodiment of a mobile device.

To aid the reader in understanding the structure and operation of the mobile device 100, reference will now be made to FIG. 3 which shows a block diagram of an exemplary embodiment of a mobile device 100. The mobile device 100 comprises a number of components such as a main processor 102 that controls the overall operation of the mobile device 100. Communication functions, including data and voice communications, are performed through a communication subsystem 104. The communication subsystem 104 receives messages from and sends messages to a wireless network 200. In this exemplary embodiment of the mobile device 100, the communication subsystem 104 is configured in accordance with the Global System for Mobile Communication (GSM) and General Packet Radio Services (GPRS) standards, which is used worldwide. Other communication configurations that are equally applicable are the 3G and 4G networks such as EDGE, UMTS and HSDPA, LTE, Wi-Max etc. New standards are still being defined, but it is believed that they will have similarities to the network behaviour described herein, and it will also be understood by persons skilled in the art that the embodiments described herein are intended to use any other suitable standards that are developed in the future. The wireless link connecting the communication subsystem 104 with the wireless network 200 represents one or more different Radio Frequency (RF) channels, operating according to defined protocols specified for GSM/GPRS communications.

The main processor 102 also interacts with additional subsystems such as a Random Access Memory (RAM) 106, a flash memory 108, a display 110, an auxiliary input/output (I/O) subsystem 112, a data port 114, a keyboard 116, a speaker 118, a microphone 120, a GPS receiver 121, short-range communications 122, a camera 123 and other device subsystems 124.

Some of the subsystems of the mobile device 100 perform communication-related functions, whereas other subsystems may provide "resident" or on-device functions. By way of example, the display 110 and the keyboard 116 may be used for both communication-related functions, such as entering a text message for transmission over the network 200, and device-resident functions such as a calculator or task list.

The mobile device 100 can send and receive communication signals over the wireless network 200 after required network registration or activation procedures have been completed. Network access is associated with a subscriber or user of the mobile device 100. To identify a subscriber, the mobile device 100 may use a subscriber module component or "smart card" 126, such as a Subscriber Identity Module (SIM), a Removable User Identity Module (RUIM) and a Universal Subscriber Identity Module (USIM). In the example shown, a SIM/RUIM/USIM 126 is to be inserted into a SIM/RUIM/USIM interface 128 in order to communicate with a network. Without the component 126, the mobile device 100 is not fully operational for communication with the wireless network 200. Once the SIM/RUIM/USIM 126 is inserted into the SIM/RUIM/USIM interface 128, it is coupled to the main processor 102.

The mobile device 100 is a battery-powered device and includes a battery interface 132 for receiving one or more rechargeable batteries 130. In at least some embodiments, the battery 130 can be a smart battery with an embedded microprocessor. The battery interface 132 is coupled to a regulator (not shown), which assists the battery 130 in providing power V+ to the mobile device 100. Although current technology makes use of a battery, future technologies such as micro fuel cells may provide the power to the mobile device 100.

The mobile device 100 also includes an operating system 134 and software components 136 to 146 which are described in more detail below. The operating system 134 and the software components 136 to 146 that are executed by the main processor 102 are typically stored in a persistent store such as the flash memory 108, which may alternatively be a read-only memory (ROM) or similar storage element (not shown). Those skilled in the art will appreciate that portions of the operating system 134 and the software components 136 to 146, such as specific device applications, or parts thereof, may be temporarily loaded into a volatile store such as the RAM 106. Other software components can also be included, as is well known to those skilled in the art.

The subset of software applications 136 that control basic device operations, including data and voice communication applications, may be installed on the mobile device 100 during its manufacture. Software applications may include a message application 138, a device state module 140, a Personal Information Manager (PIM) 142, a connect module 144 and an IT policy module 146. A message application 138 can be any suitable software program that allows a user of the mobile device 100 to send and receive electronic messages, wherein messages are typically stored in the flash memory 108 of the mobile device 100. A device state module 140 provides persistence, i.e. the device state module 140 ensures that important device data is stored in persistent memory, such as the flash memory 108, so that the data is not lost when the mobile device 100 is turned off or loses power. A PIM 142 includes functionality for organizing and managing data items of interest to the user, such as, but not limited to, e-mail, contacts, calendar events, and voice mails, and may interact with the wireless network 200. A connect module 144 implements the communication protocols that are required for the mobile device 100 to communicate with the wireless infrastructure and any host system, such as an enterprise system, that the mobile device 100 is authorized to interface with. An IT policy module 146 receives IT policy data that encodes the IT policy, and may be responsible for organizing and securing rules such as the "Set Maximum Password Attempts" IT policy.

Other types of software applications or components 139 can also be installed on the mobile device 100. These software applications 139 can be pre-installed applications (i.e. other than message application 138) or third party applications, which are added after the manufacture of the mobile device 100. Examples of third party applications include games, calculators, utilities, etc.

The additional applications 139 can be loaded onto the mobile device 100 through at least one of the wireless network 200, the auxiliary I/O subsystem 112, the data port 114, the short-range communications subsystem 122, or any other suitable device subsystem 124.

The data port 114 can be any suitable port that enables data communication between the mobile device 100 and another computing device. The data port 114 can be a serial or a parallel port. In some instances, the data port 114 can be a USB port that includes data lines for data transfer and a supply line that can provide a charging current to charge the battery 130 of the mobile device 100.

For voice communications, received signals are output to the speaker 118, and signals for transmission are generated by the microphone 120. Although voice or audio signal output is accomplished primarily through the speaker 118, the display 110 can also be used to provide additional information such as the identity of a calling party, duration of a voice call, or other voice call related information.

For text-based communications, for example e-mail, signals from the keyboard 116 are processed by the main processor 102 and may be represented as corresponding symbols and characters on the display 110. The text-based data can be sent to the communication subsystem 104 before being transmitted over the wireless network 200.

The keyboard 116 comprises a plurality of push keys that are generally positioned towards the exterior housing of the mobile device 100. Push keys may be used for various other applications, including for example, a menu or option button 24, a cancel or escape button 16 and a convenience button 15. Most keys operate by receiving a force that pushes the key in a direction towards the housing.

Figure 4:
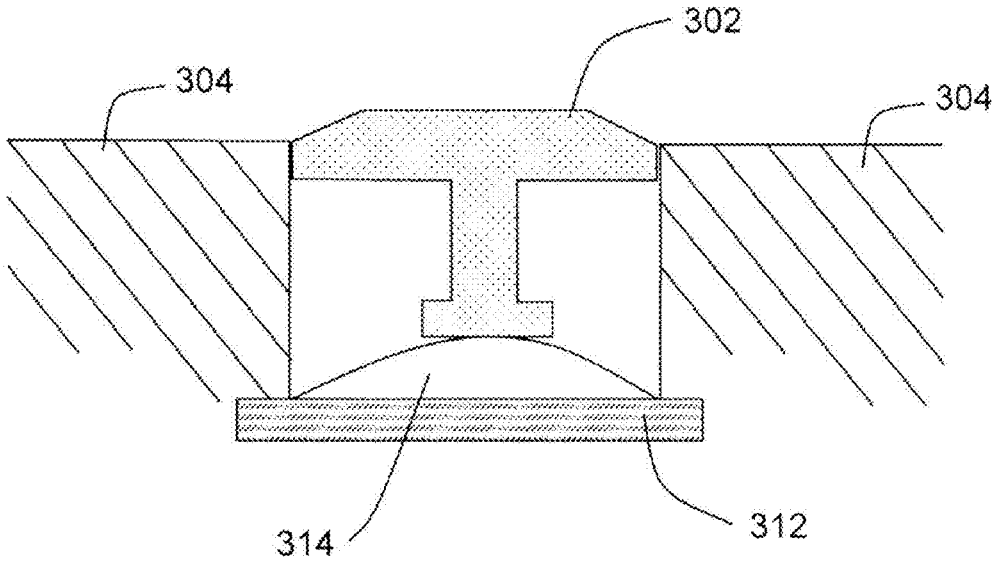
FIG. 4(*a*) is a cross-sectional elevation view of a key and dome switch in a rest position.
Figure 4:
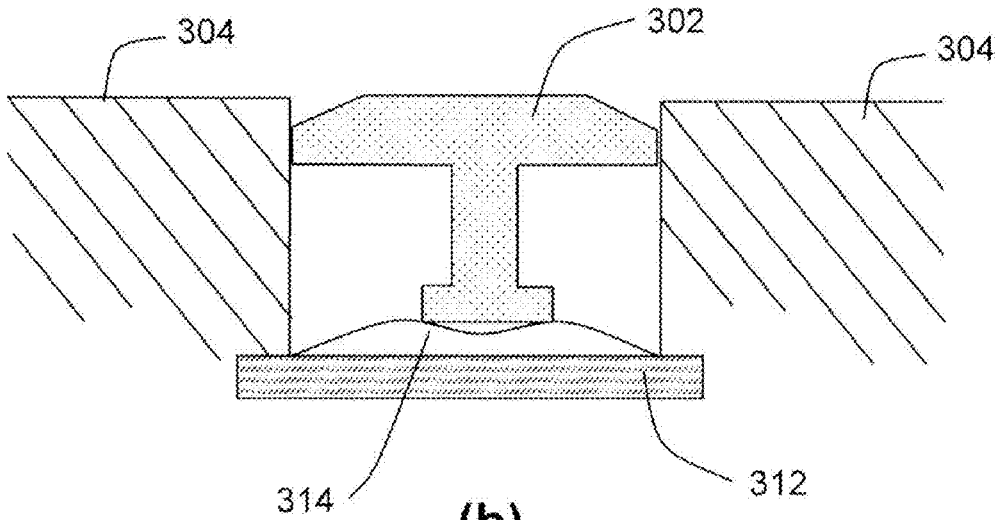

Turning to FIG. 4(*a*), an exemplary push key 302 is shown disposed towards the exterior of the housing 304 of a mobile device. In this example, the push key 302 is substantially aligned with the apex of a dome switch 314 and the push key 302 may be generally restricted to movement in a direction towards the dome switch assembly 314. The dome switch 314 is supported by a dome switch base 312. The dome base 312 may comprise a rigid or flexible material. Examples of the dome base 312 material comprise a printed circuit board, a flexible circuit, or a rigid plastic. The broad surface of the push key 302 may be elevated above the surface of the housing 304 to allow for a force to easily act on the push key 302.

As shown in FIG. 4(*b*), upon the push key 302 receiving a force, the push key 302 moves towards the dome switch 314 and transfers the force towards the apex of the dome switch 314. In effect, the dome switch 314 collapses and which then completes an electrical circuit. In this position, the elevation of the top surface of the push key 302 may lower with respect to the housing face 304 such that the push key 302 is recessed, thus providing tactile feedback.

It can be appreciated that the push key 302 is only one of a number of configurations of possible keys or buttons. A clickable trackball, trackwheel or any other push-type input device can likewise serve a function similar to that of a push key, imparting a force to the dome switch 314.

Figure 5:
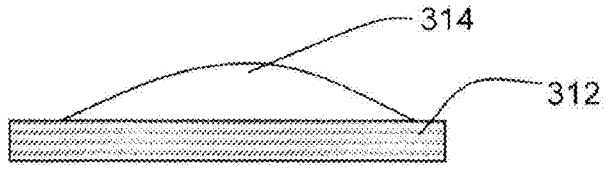
FIG. 5(*a*) is an elevation view of a dome switch in isolation.
Figure 5:
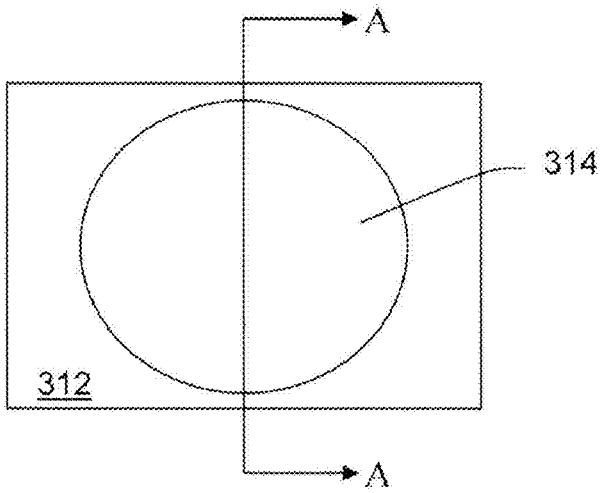

FIG. 5(*a*) shows the exterior of an exemplary dome switch assembly comprising a dome switch 314 supported by a base 312. FIG. 5(*b*) portrays a top planar view of the dome switch 314 and base 312 with respect to one another.

Figure 6:
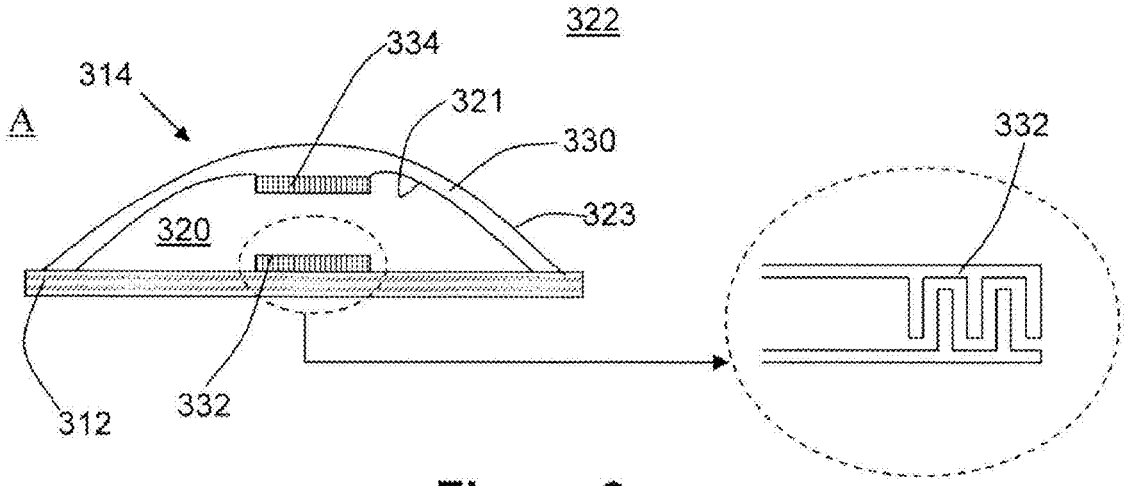
FIG. 6 is a cross-sectional elevation view of the dome shown in FIGS. 5(*a*) to 5(*b*) with a partial plan view of a pair of conductive terminals.

In FIG. 6, a cross-sectioned view shows that the dome switch 314 comprises a dome-shaped shell 330 comprised of resilient material that is able to be collapsed and resiliently recover over many cycles, and maintain its shape in the absence of a applied downward force. The dome shell 330 defines and separates an interior space 320 from the exterior 322 of the dome switch 314. The dome shell 330 comprises an interior surface 321 and an exterior surface 323, wherein the interior surface 321 interfaces with at least a portion of the dome's interior space 320. Located on the interior surface 321 of the dome shell 330, at the apex, is a contact pad 334 comprised of an electrically conductive material. Aligned with the contact pad 334, and also located within the dome's interior space 320, is a pair of electrically conductive terminals 332 that are electrically isolated by way of a physical space or gap. Upon receiving an applied downward force, the dome shell 330 collapses inwardly and thereby lowers the apex of the dome and the attached dome contact pad 334 towards and then into engagement with the contact terminals 332. When the contact pad 334 engages the terminals 332, an electric circuit may be completed.

It is recognized that there are various embodiments of dome switches. One embodiment of a resilient dome shell 330 is a conductive metal dome 330*a*, which is given the suffix "a" for clarity. FIGS. 7 through 10 illustrate an embodiment of a dome switch 314 comprising a metal dome 330*a*. It is noted that a conventional metal dome 330*a* may comprise a material such as stainless steel and may have a low profile height, in some examples, ranging between 300 microns and 1000 microns. The dome shell 330 may also comprise other resilient materials including, for example, plastics, rubbers and silicones, polymers, etc. It can be seen that any resilient material that allows the dome shell to collapse and resiliently recover to its original form is applicable to the principles herein.

Dome switches advantageously provide tactile feedback as to when the dome is collapsed and when it recovers. Thus, a user pressing down on dome switch can feel the two distinct positions of the dome switch.

Figure 7:
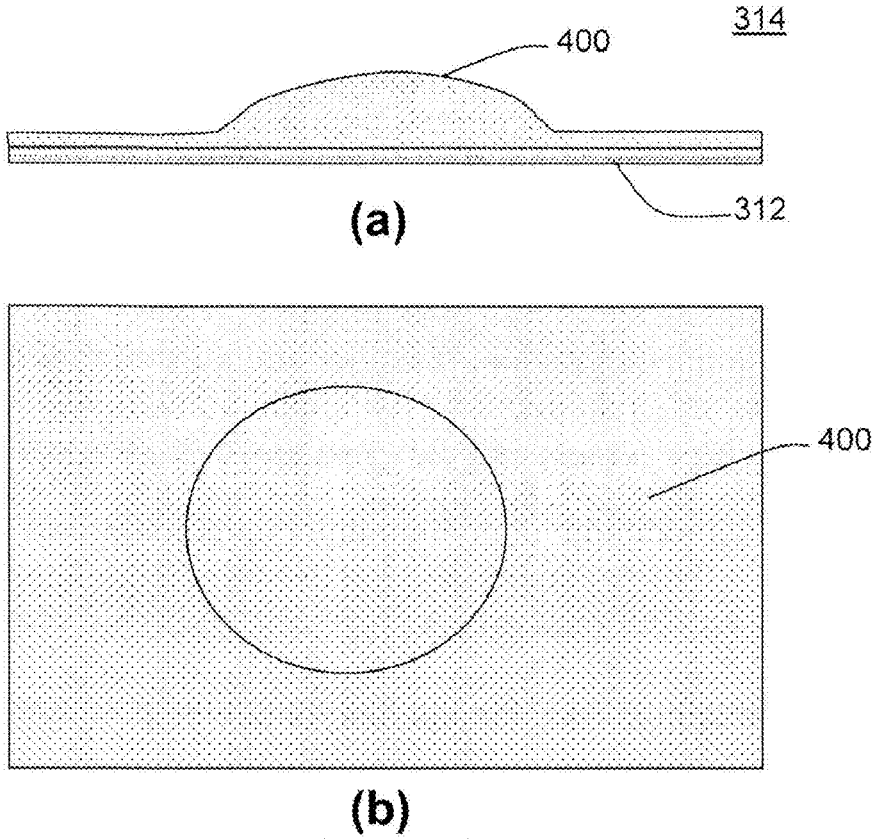
FIG. 7(*a*) is an elevation view of a metal dome switch assembly.

Turning first to FIG. 7(*a*), an elevation view shows an embodiment of a dome switch assembly 314, wherein the dome 330*a* is made of metal and is covered by a thin dome sheet 400. The dome sheet 400 generally comprises a material that is non-conductive and flexible, such as for example, polyester. FIG. 7(*b*) shows a planar view from above of this metal dome switch assembly 314.

Figure 8:
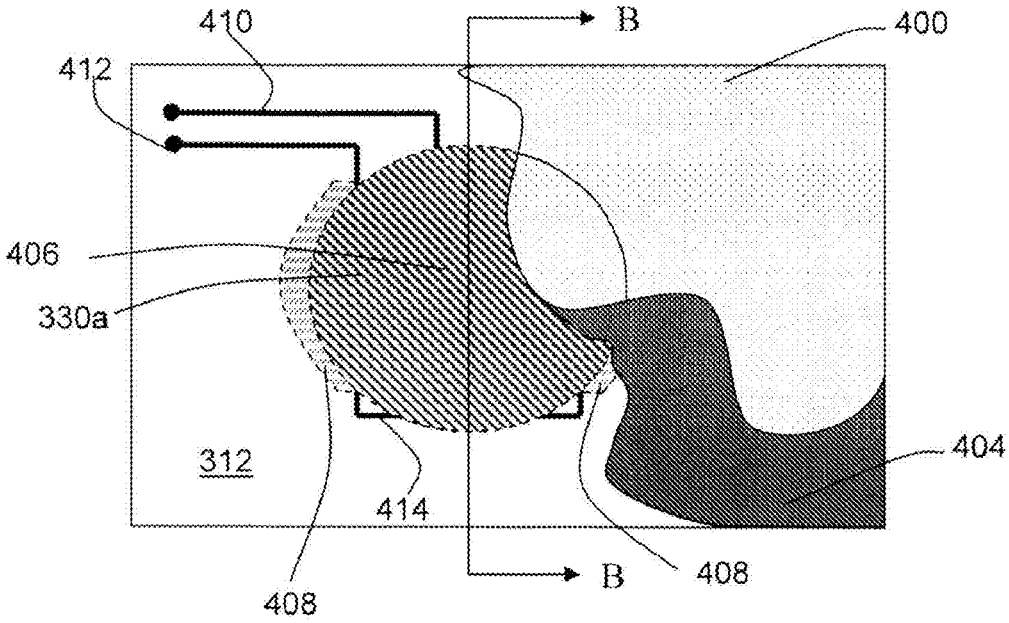
FIG. 8 is a plan view of the various layers in a metal dome switch assembly shown in FIG. 7.
Figure 9:
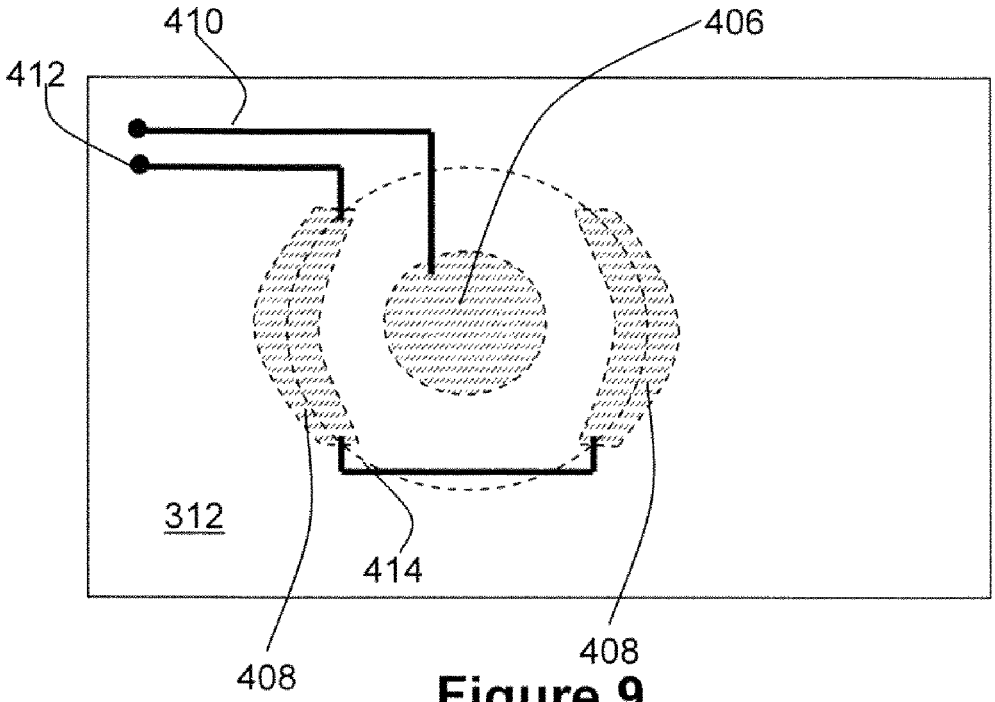
FIG. 9 is a plan view of one layer in a metal dome switch assembly shown in FIG. 8.

FIG. 8 shows a partial cut-away view of the metal dome switch assembly, wherein the most exterior layer is the dome sheet 400. The dome sheet 400 is attached to a metal dome 330*a* and dome base 312 by an adhesive 404. Note that the adhesive 404 may cover the majority of the area under the dome sheet 400. The metal dome 330*a* maintains contact with two peripheral pads 408 that are electrically conductive. Given that the metal dome 330*a* is made of a resilient material that is electrically conductive and, in some embodiments, there may be an electrical lead 414 that connects the two peripheral pads 408, therefore the two peripheral pads 408 and the metal dome 330*a* are all electrically connected to each other and have a substantially similar electric potential. When the metal dome 330*a* is in a collapsed state, the inner apex of the dome connects to an electrically isolated contact 406 which is positioned opposite to the apex. The electrical contacts are best shown in FIG. 9, wherein the dome sheet 400, adhesive 404 and metal dome 330*a* have been removed for illustrative purposes.

In this embodiment, one of the peripheral pads 408 is connected to a terminal lead 412. Another terminal 410 is connected to the isolated contact 406, which is positioned towards the center area between the peripheral pads 408.

Figure 10:
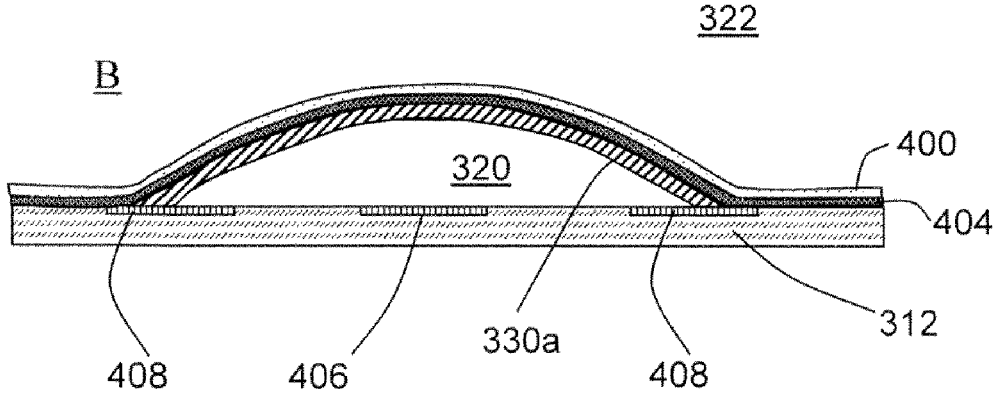
FIG. 10 is a cross-sectional elevation view of the metal dome switch assembly shown in FIG. 8.

In FIG. 10, a cross-sectional elevation view is shown according to FIG. 8. The peripheral pads 408 and the isolated contact 406 are generally thin and can be embedded within the dome base 312. As shown clearly, the isolated contact 406 is positioned within the interior portion 320 of the dome switch assembly. The layer of adhesive 404 covers the exterior of the metal dome 330*a*, while the dome sheet 400 is fixed to the exterior of the adhesive 404.

It will be appreciated that dome switches are not limited to any particular geometry. By way of example, the dome elevation profile may also take may the shape of a trapezoid, a triangle, or a rectangle. In addition, the upper portion of the dome may be wider than the lower portion of the dome, such as in an inverted trapezoid for example. Some various embodiments of the metal dome shell 330*a* may include a dimple located at the apex and four legs located towards the bottom of the dome shell 330*a*.

Although not shown in FIGS. 5 through 10, a traditional dome switch 314 typically comprises a passageway between the exterior of the dome 322 and the interior of the dome 320. The passageway allows for air to travel between the dome's exterior 322 and interior space 320 which may occur when the interior volume of the dome changes. For example, when the dome 314 collapses inwardly, the dome's interior volume 320 decreases and pushes air out towards the exterior 322. The exterior space 322 to the dome 314 may usually be considered to be at ambient pressure. As some air moves from the interior space 320 towards the exterior 322, the air pressure within the dome's interior space 320 approaches the same ambient pressure as the exterior space 322.

Similarly, after the force collapsing the dome shell 330 has been removed, and while the collapsed resilient dome shell 330 recovers to its original form, the volume within the dome's interior space 320 increases. Air from the exterior space 322 is also drawn into the dome's interior space 320 during the dome shell's 330 recovery. The passageway allows air to travel between the exterior 322 and interior space 320, thereby allowing the air pressure within the dome's interior space 320 to substantially equal to the ambient air pressure of the exterior space 322.

The passageway however, may also allow for other media, in addition to air, to travel between the exterior 322 and interior space 320. For example, dirt particles and liquids from the exterior 322 may travel through the passageway and into the dome's interior space 320. In one exemplary situation, water may spill onto the keyboard and travel through the passageway into the dome's interior space 320. The water may come into contact with both the dome's contact pad 334 and the conductive terminals 332, and can thereby inadvertently short the electrical circuit. In another example, sand may be blown onto a keyboard. A sand particle may travel through the passageway into the dome's interior and become lodged between the contact pad 334 and conductive terminals 332. As the dome switch 314 collapses, the sand particle may prevent the contact pad 334 from engaging the conductive terminals 332, and can thereby inadvertently prevent an electrical connection. This situation may also apply to the embodiment comprising a metal dome shell 330*a*, wherein the sand particle may prevent the dome shell 330*a* from engaging the isolated contact 406 to complete a circuit. As such, there is a need to prevent unwanted media, such as, for example, dirt and water, from entering into a dome switch's interior space 320.

One approach to prevent unwanted media from contaminating the dome switch's interior space 320 is to seal the dome. A seal may be used to cover each passageway between the dome's interior space 320 and exterior 322 to block out unwanted media from entering the dome's interior space 320.

However, if the air within the dome's interior space 320 was completely sealed from the exterior 322, the air pressure within the dome's interior space 320 would prevent the dome shell 330 from smoothly collapsing and resiliently recovering. For example, when a force is applied downwards onto the apex of the dome switch 314, the sealed air within the dome's interior space 320 would produce a counter force that pushes outwards against the interior walls of the dome shell 330, including the apex. This force caused by the increased air pressure can prevent the apex from collapsing and prevent the contact pad 334 from engaging the conductive terminals 332 below. Therefore, a passageway is needed to allow for the flow of air, thereby allowing the dome switch 314 to collapse and recover smoothly.

Further to the movement and functionality of the dome shell 330, the air pressure within the sealed dome switch's interior space 320 may also affect a substrate, not shown, which is located at the top surface of the dome base 312. The substrate typically comprises a thin layer of laminate that can be used to secure items, for example a conductive terminal 332, to the dome base 312. In the dome switch's collapsed position, and in the absence of an applied force, the dome shell 330 may be in the process of a resilient recovery wherein a vacuum pressure within the dome's interior space 320 tends to draw in air from the exterior 322. This vacuum pressure may increase because the passageways have been sealed to prevent the flow of air. This increased vacuum pressure may create a pulling force against the substrate and can, over many actuation cycles, cause the substrate to peel away from the dome base 312, which in effect, may dislodge the conductive terminal 332 from its original position. The problem is magnified in dome switches where the dome quickly recovers to its original position, for example through a snap action, thereby creating a stronger vacuum force. Therefore, a passageway that allows the flow of air is provided to mitigate the risk of damage towards the substrate.

Figure 11:
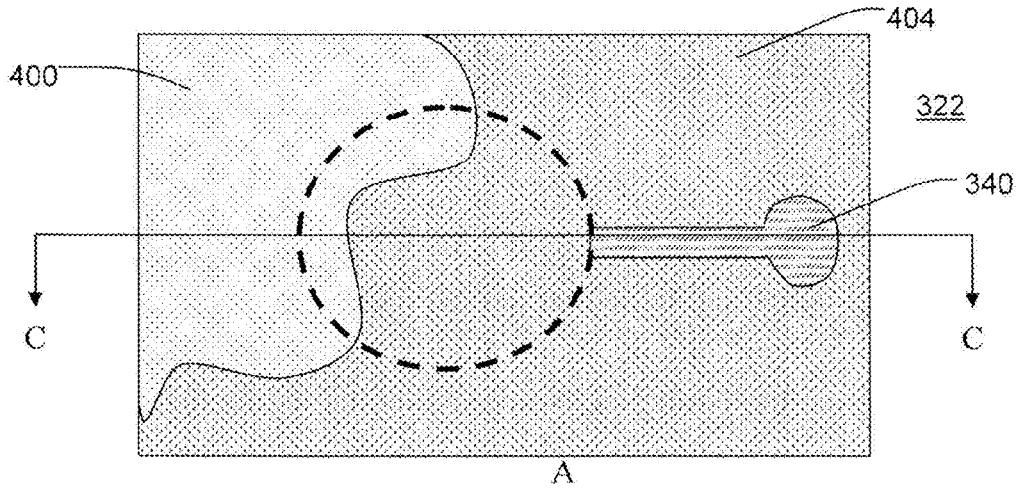
FIG. 11 is a plan view showing various layers of a breathable sealed dome switch assembly with a metal dome.
Figure 12:
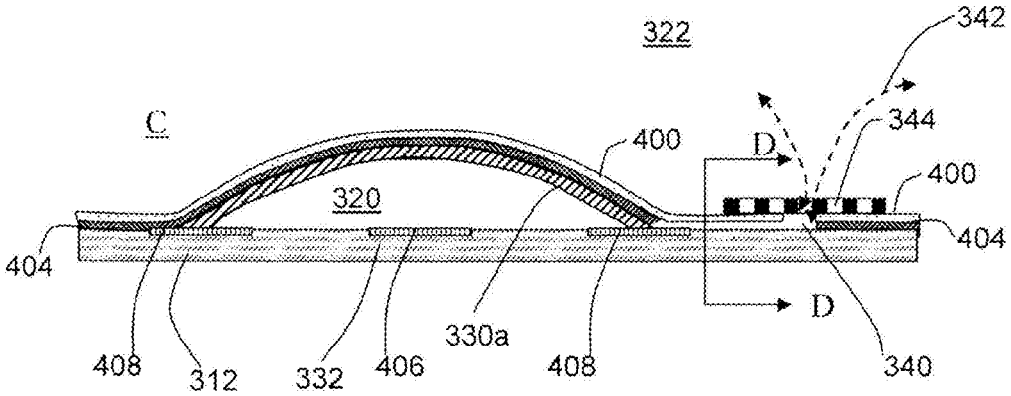
FIG. 12 is a cross-sectional elevation view of the breathable sealed dome switch assembly shown in FIG. 11 along line C-C.
Figure 13:
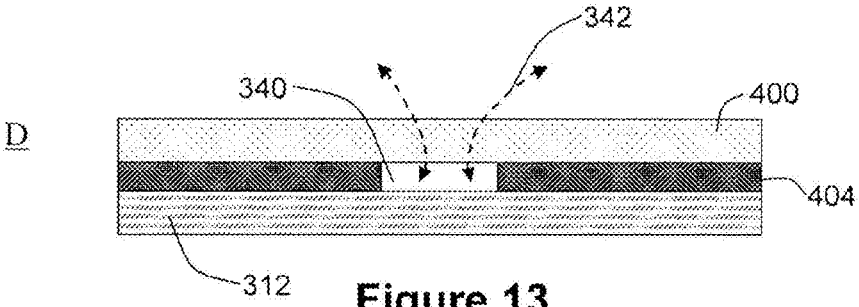
FIG. 13 is a cross-sectional elevation view of the layers of the breathable sealed dome switch assembly shown in FIG. 12 along line D-D.

Referring to FIGS. 11 through 13, an embodiment of a breathable sealed dome switch assembly comprises a single dedicated vent 340 to allow the flow of air 342 between the dome's interior space 320 and exterior 322. In general terms, the vent 340 fluidly connects the interior space 320 at a first end of the vent, to the exterior 322 at a second end of the vent 340. In this embodiment, a metal dome shell 330*a* is used with an adhesive 404 and a dome sheet 400. The combination of the adhesive layer 404 and dome sheet 400 seals the dome switch assembly, while still allowing the dome shell 330*a* to collapse and resiliently recover, for example through a snap action. It can be appreciated that the dome shell 330*a* significantly deforms so that the apex of the dome shell 330*a* moves downwards to engage the isolated electrical contact 406. During the collapse and recovery of the dome shell 33*a*, adhesive 404 and dome sheet 400 are adhered to the dome shell 330*a* and thus deform with the dome shell 330*a*. This maintains a seal between the dome sheet 400 and dome shell 330*a* and reduces the relative movement of parts. The reduction of the relative movement of parts in the dome switch assembly reduces the risk of parts rubbing against one another and wearing down, therefore increasing the number of cycles that the dome switch can be collapsed and recovered.

The vent 340 is a channel created between the dome base 312 and dome sheet 400, such that the adhesive 404 is absent. In other words, the vent extends through the space defined, among other things, by the adhesive. FIG. 11 shows the majority of the dome sheet 11 removed, revealing the adhesive 404 layer below and the vent 340 comprised from the absent adhesive material 404. FIG. 13 also reveals the vent 340 disposed between the base 312 and dome sheet 400, and surrounded by the adhesive 404. The vent 340 extends between the edge of the metal dome shell 330*a*, considered the first end of the vent, towards an exterior opening, considered the second end of the vent, wherein the opening is sealed by a membrane 344. In this example, shown best in FIG. 12, the vent opening is located away from the dome shell 330*a* to mitigate any effects possibly caused by placing the membrane 344 near the metal dome shell 330*a*. For example, a thick membrane 344 that is placed over the dome shell 330*a* may affect the collapse and recovery of the dome shell 330*a*.

It can be appreciated that placing the vent in the space defined by the adhesive 404 and dome sheet 400, among other things, advantageously allows air to flow while allowing the dome sheet 400 to adhere to the surface of the dome shell 330*a*.

Generally, the membrane 344 should be flexible. Example material for the membrane comprises polytetrafluoroethylene (PTFE), such as for example, Gore-Tex® or extended PTFE (EPTFE), or PTFE blends. Other example materials include natural or synthetic fabrics that allow air to flow through but also perform a filtering of contaminants. In general, materials that allow the flow of air and water vapour, and are resistant to liquid and small particles, including dirt, may also be suitable for the membrane 340. The membrane 344 may be secured to the below surface, such as the dome sheet 400, by using various methods including heat welding and ultrasonic welding.

In this embodiment, the breathable sealed dome switch assembly allows for the venting of air 342 between the interior space 320 and exterior 322 through the dedicated vent 340, wherein the vent 340 is covered by a membrane 344 that substantially prevents liquid and dirt particles from entering into the interior space 320. The vent 340 and membrane 344 allow the dome switch 314 to collapse and recover smoothly while mitigating the risks of liquids and dirt particles from entering into dome's interior space 320.

Other embodiments include a vent 340 disposed within the dome base 312. Alternatively, given sufficiently flexible membrane material 344, the vent 340 may be disposed within the dome shell 330*a* itself and covered, either directly or indirectly, by a membrane 344.

Figure 29:
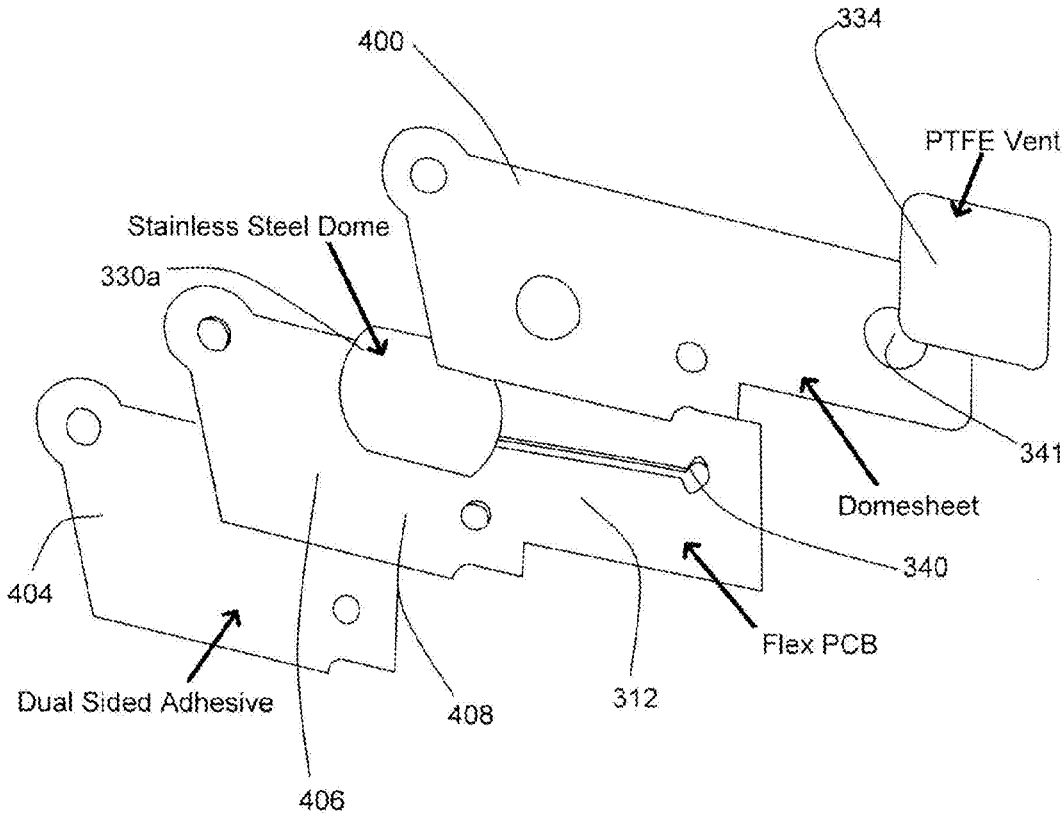
FIG. 29 is an exploded view showing various layers of another embodiment of a breathable sealed dome switch assembly with a metal dome.

FIG. 29 shows another embodiment of a breathable sealed dome switch assembly comprising a metal dome 330*a*. In this embodiment, where the dome base 312 comprises a flexible circuit, the vent 340 may be channeled through the flexible circuit. It can also be seen that another vent 341 is defined in the dome sheet 400, and that this vent 341 is aligned with at least a portion of the vent 340 in flexible circuit to allow the flow of air from within the dome shell space to the exterior.

Figure 30:
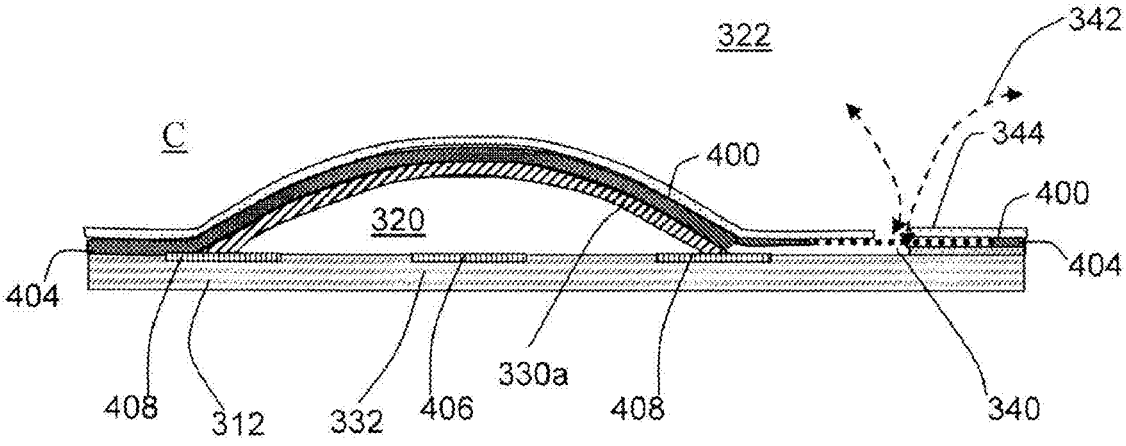
FIG. 30 is another cross-sectional elevation view of the breathable sealed dome switch assembly shown in FIG. 11 along line C-C.
Figure 31:
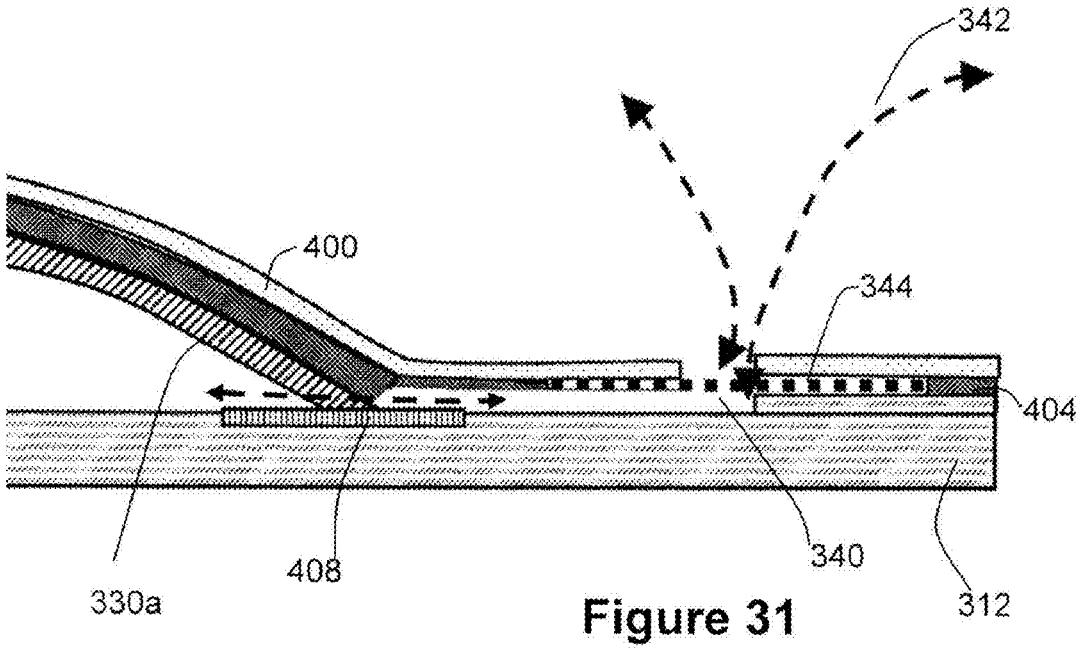
FIG. 31 is an enlarged portion of the cross-sectional elevation view of the breathable sealed dome switch assembly shown in FIG. 30.

Turning to FIGS. 30 and 31, another embodiment of a breathable sealed dome switch assembly is provided wherein the membrane 344 is positioned below the dome sheet 400 and above the base 312. It can be appreciated that as the dome shell 330*a* resiliently collapses and recovers, the dome sheet 400 and adhesive 404 deform and stretch as well. Thus, the dome sheet 400 and adhesive 404 may put the membrane 344 in tension when the dome shell 330*a* is in certain positions. In order to reduce the tension applied on the membrane 344, the membrane 344 is not bonded to the dome sheet 400, although it is held in position by the dome sheet 400, among other things. It can be understood that the non-bonded relationship between the dome sheet 400 and membrane 344 allows the membrane 344 to remain in a relaxed state even when the dome sheet 400 is in tension. Although not shown in FIGS. 30 and 31, it can be appreciated that there is a space defined between the dome shell 330*a* and the peripheral pad 408 that allows air to flow between the dome's interior space and the vent 340, while maintaining electrical conductivity between the dome shell 330*a* and the peripheral pad 408. In another embodiment, the membrane 344 is positioned below the dome sheet 400, above the dome base 312, and between the adhesive 404, and is not bonded to any of the surfaces. In other words, the membrane 344 is held in position by at least the dome sheet 400. Thus, as the dome sheet 400 and adhesive 404 are put into tension, none of the forces are transferred to the membrane 344, thus allowing the membrane 344 to remain in a relaxed state as the dome shell 330*a* collapses and resiliently recovers. This advantageously prolongs the use of the membrane 344.

Figure 32:
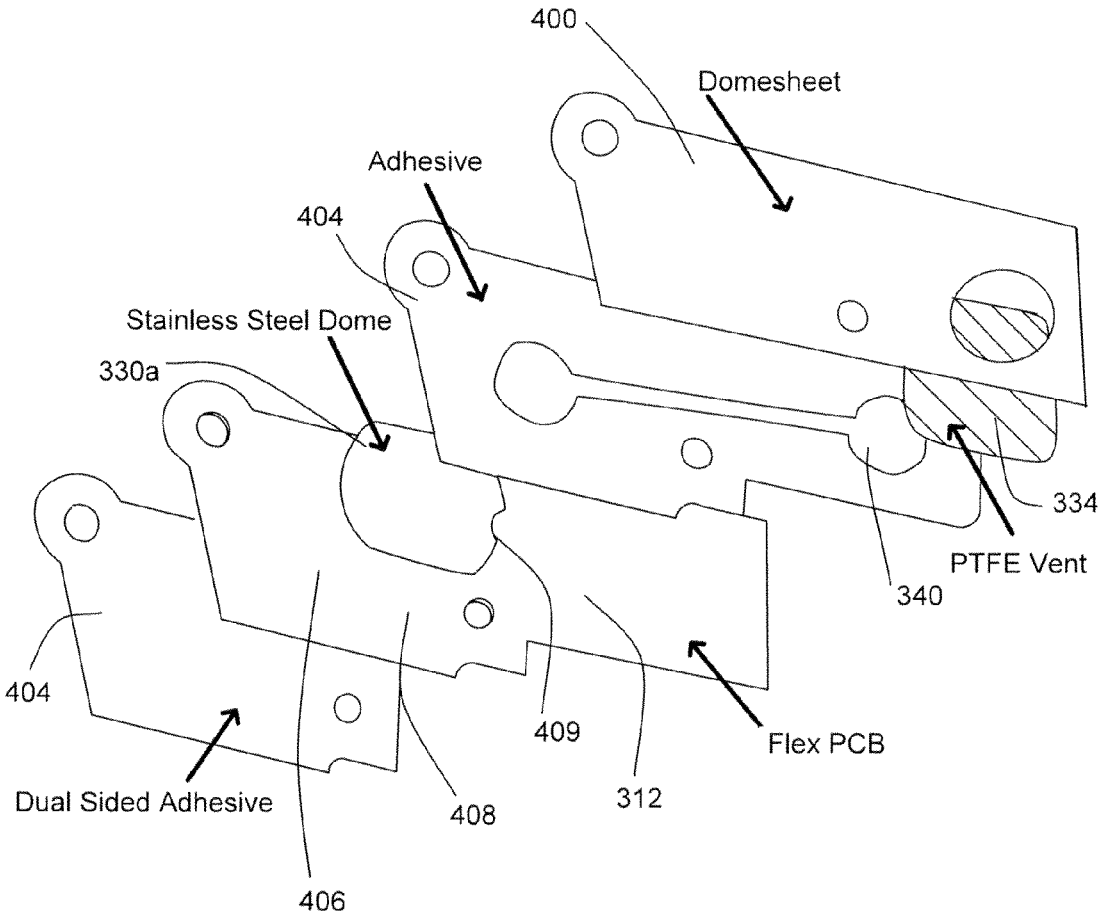
FIG. 32 is an exploded view showing various layers of an embodiment of a breathable sealed dome switch assembly with a vent defined at least by an adhesive layer.

FIG. 32 provides an embodiment of a breathable sealed dome switch assembly similar to the embodiment described with respect to FIGS. 30 and 31. The channel or vent 340 in the adhesive 404 is more clearly shown. A notch 409 defined by the dome 330*a* is also more clearly shown, whereby the notch 409 allows air to more readily flow between the dome's interior space and the vent 340.

Figure 14:
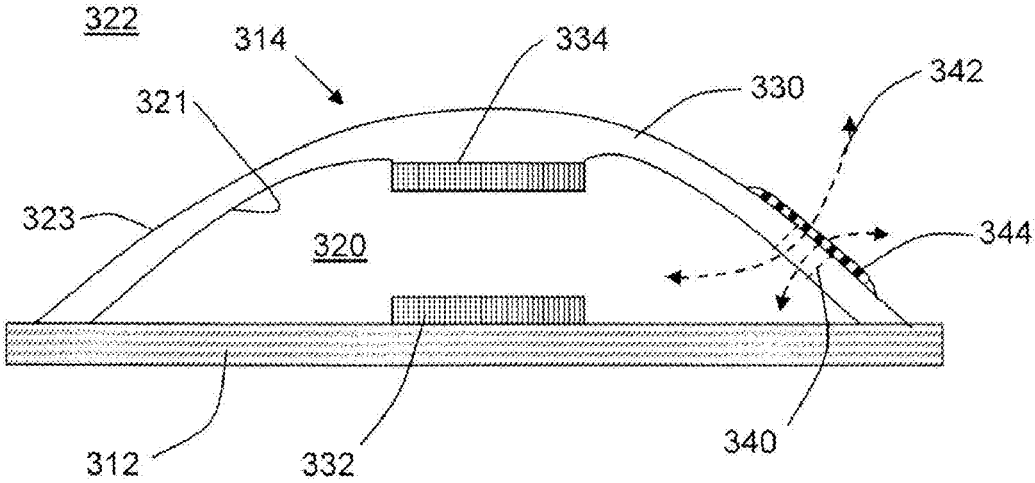
FIG. 14 is a cross-sectional elevation view of a breathable sealed dome switch assembly.
Figure 15:
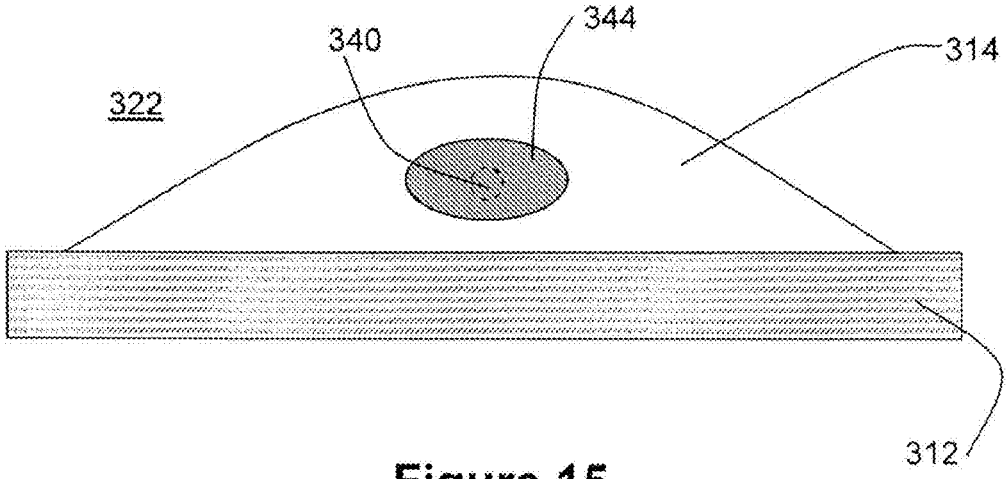
FIG. 15 is an elevation view of the switch assembly shown in FIG. 14.

Turning to FIG. 14 and FIG. 15 it has been recognized that another embodiment of a breathable sealed dome switch assembly comprises a single dedicated vent 340 to allow the flow of air 342 between the dome's interior space 320 and exterior 322. The vent 340 in this embodiment is circular in shape and is located towards the side of the resilient dome shell 330. In other words, the vent 340 extends through the interior surface 321 of the dome shell 330 to the exterior surface 323, thereby fluidly connecting the interior space 320 with the exterior 322 of the dome switch 314. It will be appreciated that the shape of the vent 340 is not limited to any particular geometry and, for example, may take the form of a square or triangle.

The vent 340 has positioned therewith, a membrane 344, which in this embodiment covers the vent 340 and which comprises material that is permeable to air and resistant to water and dirt. In this embodiment, the membrane 344 is fixed onto the exterior surface 323 of the dome shell 330 and covers the local area that surrounds the vent 340. The membrane 344 may be attached to the dome shell 330 by way of an adhesive layer. The membrane 344 in this embodiment may also be flexible to allow the resilient dome shell 330 to collapse and resiliently recover as it would normally.

Figure 16:
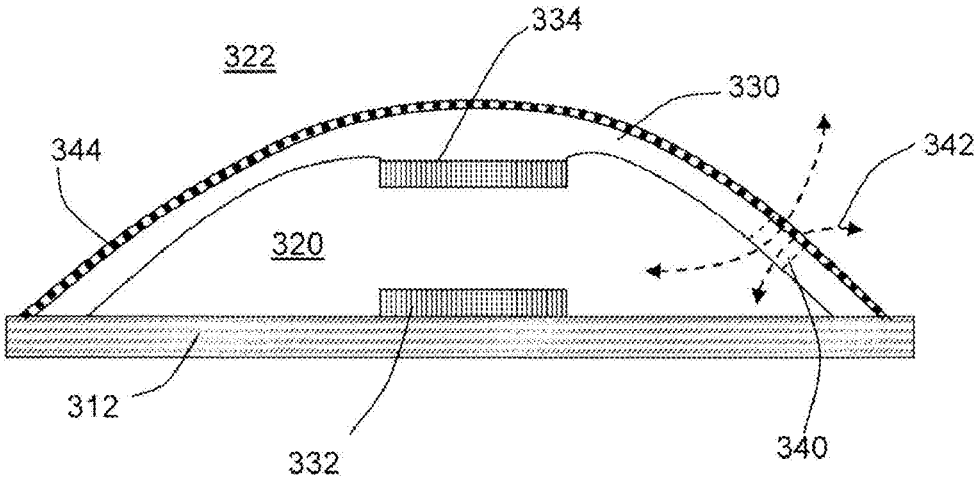
FIG. 16 is a cross-sectional elevation view of another embodiment of a breathable sealed dome switch.

FIG. 16 shows another embodiment of a breathable sealed dome switch assembly comprising a single dedicated vent 340 located on the dome shell 330, and a membrane 344 that covers the majority or all of the dome shell's 330 exterior surface area. The increased surface area of the membrane 344 may increase the protection against contaminants and may afford manufacturing advantages, including sealing the membrane 344 to the dome switch base 312 instead of the dome shell 330.

It can be understood that the membrane 344 may be positioned and configured in any number of arrangements with respect to the vent 340 such that fluid passing through the vent 340 also passes through the membrane 344. The membrane 344, as shown in some embodiments, may be positioned over one entrance or end of the vent 340. Although not shown, in some other embodiments the membrane 344 may be positioned in an intermediary section of the vent 340 or oriented at various angles across the vent, or both.

Figure 17:
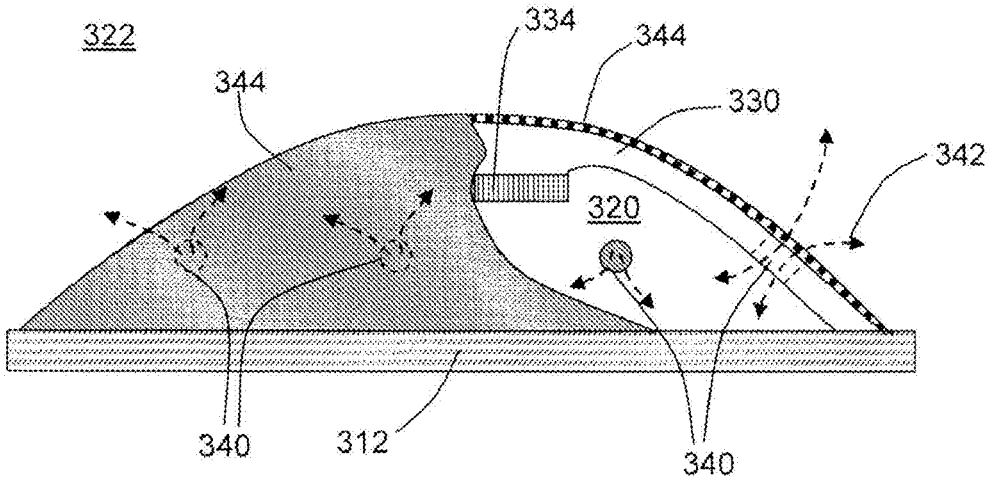
FIG. 17 is a partial cross-sectional elevation view of yet another embodiment of a breathable sealed dome switch.

Referring to FIG. 17, a partial cross-section of yet another embodiment of a breathable sealed dome switch assembly is shown, which also comprises a membrane 344 that covers the majority or all of the dome shell's 330 exterior surface area. In this embodiment, there are a plurality of vents 340 to facilitate an increase in the air flow rate between the dome's interior space 320 and exterior 322. It should be noted that the positioning, quantity, size of the vents 340 should not be limited to any particular configuration.

It can be appreciated that the configurations shown in FIGS. 14 to 17 advantageously allow a dome switch to be sealed and breathable, while using fewer components or materials, or both. Moreover, by placing the vents 340 in the angled sides of the dome shell 330*a*, dirt and liquid are more likely to slide or roll off the membrane 344, thereby reducing the risk that the membrane 344 may be clogged or have reduced air flow due to trapped dirt or pooled liquid.

Figure 18:
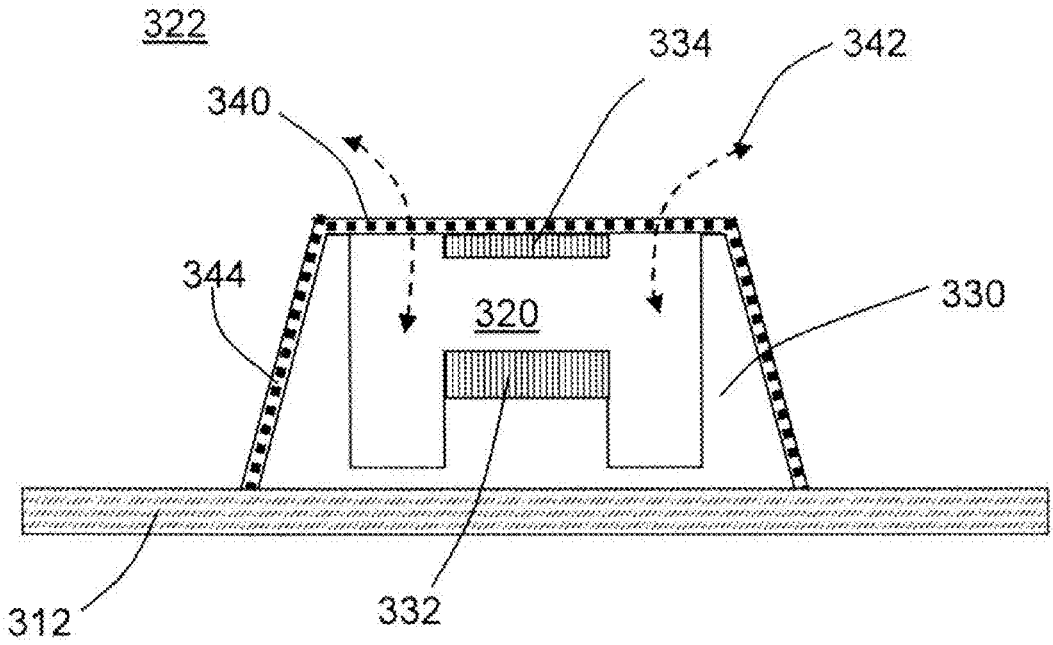
FIG. 18 is a cross-sectional elevation view of another embodiment of a breathable sealed dome switch.

FIG. 18 shows another embodiment of a breathable sealed dome switch assembly wherein the membrane 344 forms a substantial part of the dome shell structure 330. In this embodiment, the resilient dome shell material 330 surrounds the sides of the conductive terminals 332 and does not entirely extend over the top of the conductive terminals 332. The position of the contact pad 334 remains at the apex of the dome switch assembly 314 and is supported by the membrane 344. The majority of the upper portion in effect becomes a large vent 340 for air to travel through. The membrane 344 covers the upper portion of the dome switch and also functions to receive the downward forces from, for example, a push key 302. It can be seen that the membrane 344 is positioned with the large vent 340, such that air passing through the large vent 340 also passes through the membrane 344.

Figure 19:
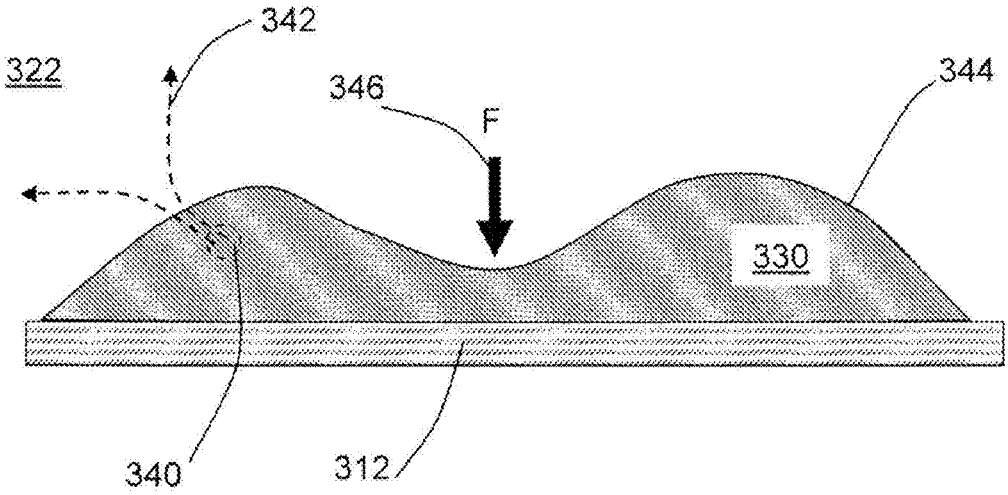
FIGS. 19(*a*) and 19(*b*) illustrate operational stages for a breathable sealed dome switch.
Figure 19:
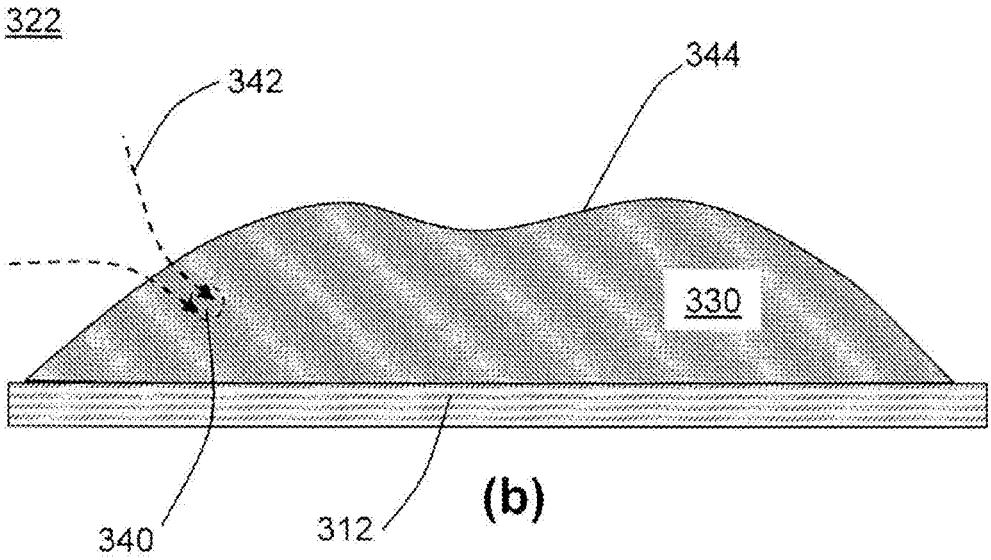

Turning now to FIG. 19, the operation of a breathable sealed dome switch is illustrated. FIG. 19(*a*) shows a force 346 acting downwardly upon the apex of the dome switch, thereby collapsing the dome shell 330. As the interior volume decreases, air 342 is pushed out through the dedicated vent 340 and passes through the air permeable membrane 344. In the collapsed position, the contact pad 334 can engage the conductive terminals 332. In FIG. 19(*b*), in the absence of an applied force 346, the collapsed dome shell 330 resiliently recovers and air 342 is drawn into the dome's interior space 320 by passing through the membrane 344 and the vent 340. As the air 342 fills the interior space 320 of the dome, the volume of the interior space 320 also increases. The use of a dedicated vent 340 and the membrane 344 still allows for a sealed dome switch assembly to operate as other conventional dome switches, while affording the advantage of protection against the ingress of contaminants.

It may be noted that in some cases a vent 340 placed in the compressible portion of the dome shell 330 may affect the dome shell's ability to collapse and resiliently recover. For example, a circle-shaped hole in the side of a dome shell 330 may alter the structural integrity of the dome shell 330. Such effects towards the dome shell's functionality may be mitigated by situating the vent 340 in the dome base 312.

Figure 20:
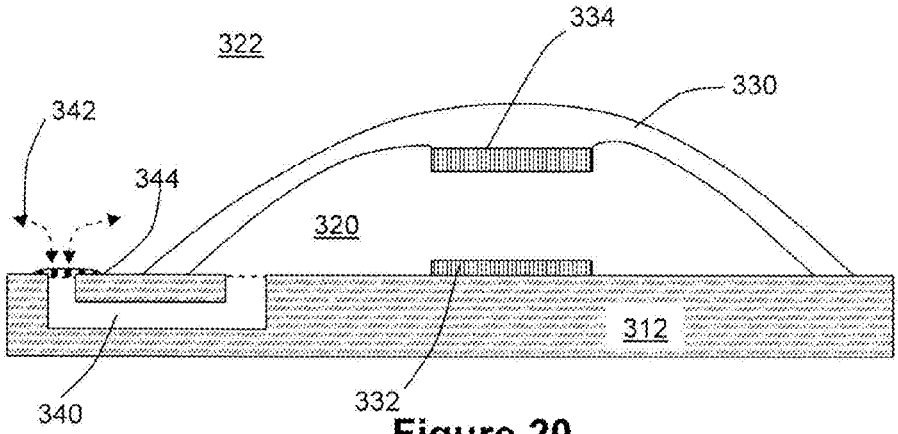
FIG. 20 is a cross-sectional elevation view of another embodiment of a breathable sealed dome switch comprising a dedicated vent.

FIG. 20 shows another embodiment of a breathable sealed dome switch assembly comprising a vent 340 extending through the dome base 312 between the dome exterior 322 and dome's interior space 320. The generally U-shaped vent 340 in this example has a single opening, also called the first end, located within the interior space 320 of the dome at the base 312. The corresponding exterior vent opening, also called the second end, is covered with a membrane 344 to inhibit the ingress of liquids and dirt particles through the vent 340 and to the dome's interior space 320.

Figure 21:
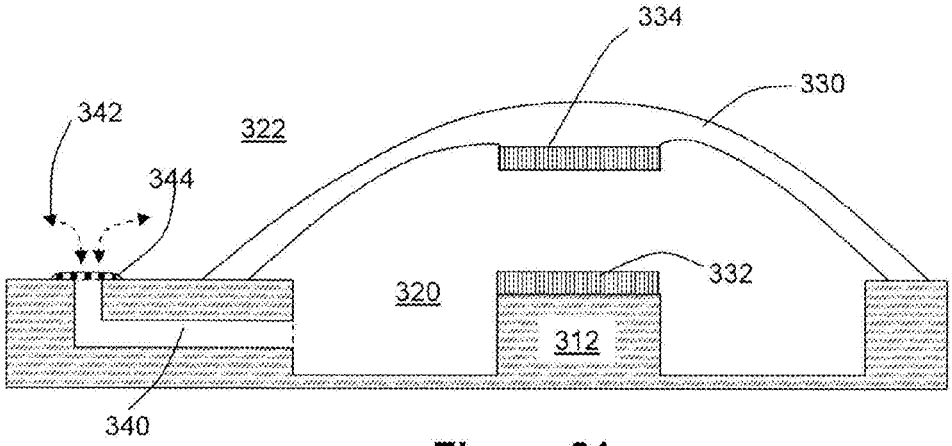
FIG. 21 is a cross-sectional elevation view of yet another embodiment of a breathable sealed dome switch comprising a dedicated vent.

It may be noted that the vent 340 and dome base 312 should not be limited to any particular configuration. For example, FIG. 21 shows another embodiment that is similar to the embodiment of FIG. 20, with a difference in the vent 340 and base 312 configuration. Portions of the base 312 may be removed to reduce the number of turns in a vent 340. A reduction in the number of turns may simplify the manufacturing of a vent 340 embedded within the dome's base 312. In this embodiment, the vent 340 is L-shaped and has one less turn in comparison to a U-shaped vent. It yet another variation, not shown here, the vent 340 may be straight and angled upwards from the interior space 320 to the upper surface of the base 312 at the exterior 322.

Figure 22:
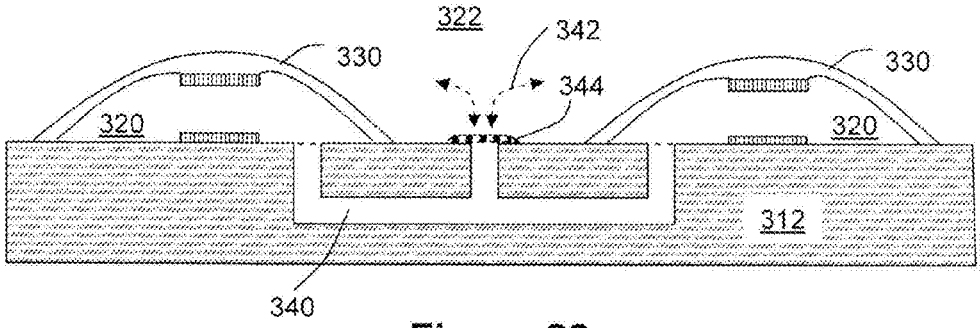
FIG. 22 is a cross-sectional elevation view of another embodiment of a breathable sealed dome switch comprising a shared vent.

Turning to FIG. 22, a breathable sealed dome switch assembly may also comprise a plurality of dome switches that share a vent 340 that is fluidly networked between the exterior 322 and the interior space 320 of each dome. In the embodiment illustrated in FIG. 22, a vent 340 extends between the interiors 320 of two dome switches 314 and has a single opening towards the exterior 322. The vent's 340 exterior entrance is covered by a membrane 344 to allow for air flow 342. This example of a shared exterior vent entrance reduces the amount of membrane material 344 required to seal the set of dome switch assemblies. A vent 340 configured to network multiple dome interior spaces 320 may be suitable in applications where multiple dome switches are placed in close proximity within one another, such as in a keyboard application.

Figure 23:
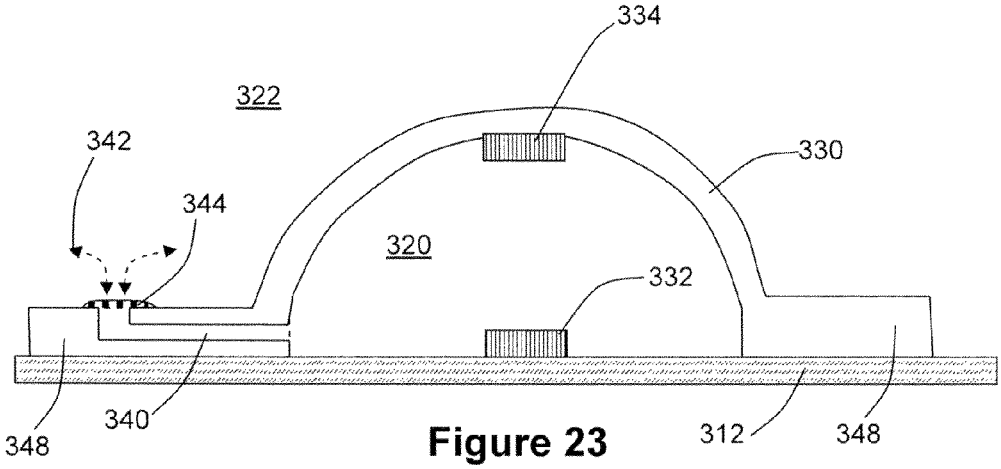
FIG. 23 is a cross-sectional elevation view of an another embodiment of a breathable sealed dome switch comprising a dedicated vent.

Referring now to FIG. 23, a vent 340 may also be disposed within the peripheral structure 348 of the dome shell 330. In the peripheral structure 348 of the dome shell 330, which is also comprised of the same resilient material as the dome shell 330, a vent 340 extends from the interior space 320 of the dome to the exterior 322. Similar to other embodiments, the vent 340 fluidly connects the interior space 320 at a first end to the exterior 322 of the dome switch 314 at a second end. The interior entrance, or first end, to the vent 340 is located in the vicinity where the dome shell 330 and peripheral structure 348 meet. The exterior entrance, or second end, to the vent 340 is covered by a membrane 344. It is noted that that the dome shell 330 comprises the peripheral structure 348, since the peripheral structure 348 is integrally formed with the dome shell 330. It can also be seen in FIG. 23, the peripheral structure 348 may have a greater thickness than the dome shell. The peripheral structure 348 does not collapse and recover when a force is applied because the structure 348 is substantially thicker and, therefore, more rigid than the shell portion 330. Therefore, the vent 340 remains open even as the dome shell 330 is being collapsed, which allows air 342 to flow between the interior space 320 and exterior 322. This embodiment avoids placing the vent 340 directly on the portion of the dome shell 330 that collapses and recovers. As noted above, the placement of a vent 340 on the resiliently compressible portions of the dome shell 330 may affect the way in which the dome shell 330 functions. Placing the vent within the peripheral structure of the dome shell 330 offers an alternative which can reduce the need to alter the dome base 312 in some embodiments.

Figure 24:
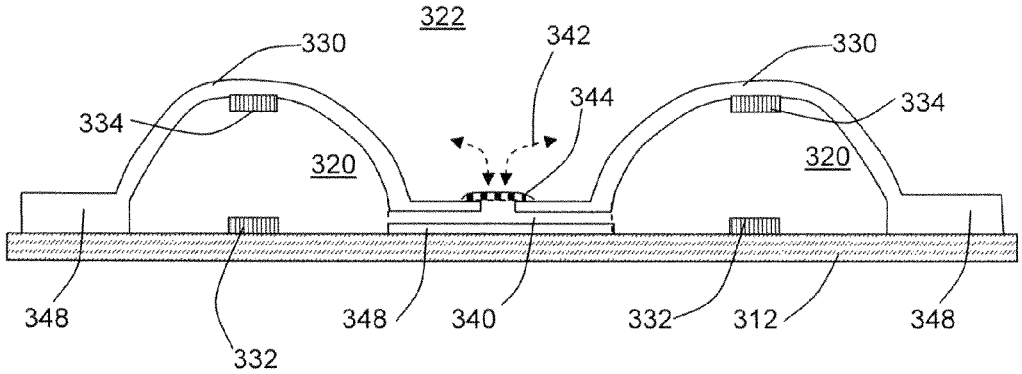
FIG. 24 is a cross-sectional elevation view of an another embodiment of a breathable sealed dome switch comprising a shared vent.

FIG. 24 illustrates another embodiment of a vent 340 disposed within the peripheral structure 348 of the dome shell 330. The vent 340 networks the interiors 320 of two domes towards a single entrance leading to the exterior 322. This configuration may be suitable for keyboard applications, for example, which can require multiple dome switches to be place in close proximity with one another. Similar to the above sealed dome switch assemblies, the vent entrance to the exterior 322 is covered with a membrane 344 to protect against contaminants such as dirt and liquid.

Figure 25:
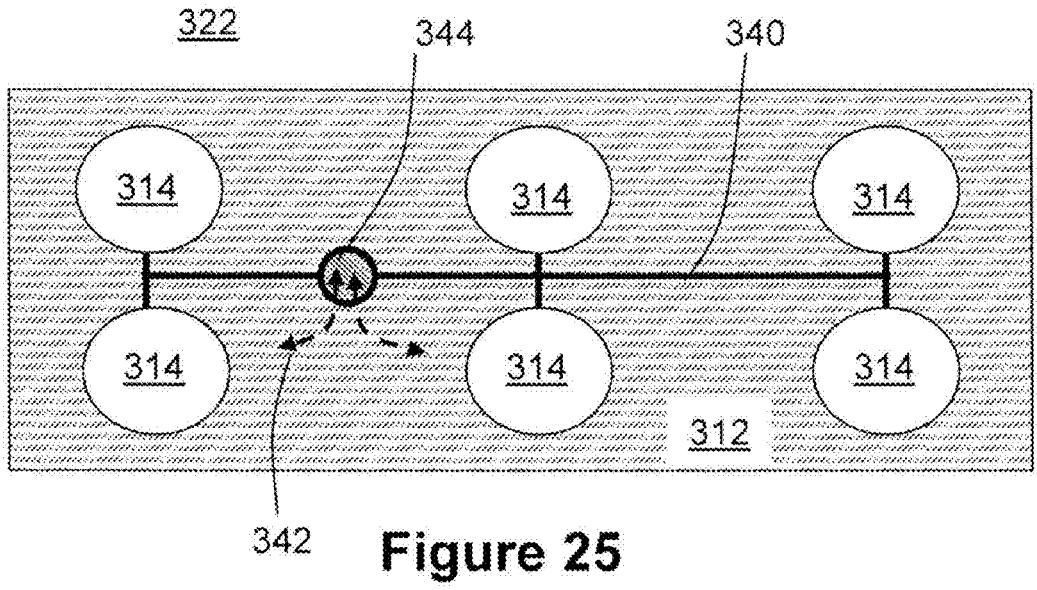
FIG. 25 is a top plan view of an embodiment of a set of breathable sealed dome switches comprising a shared vent.
Figure 26:
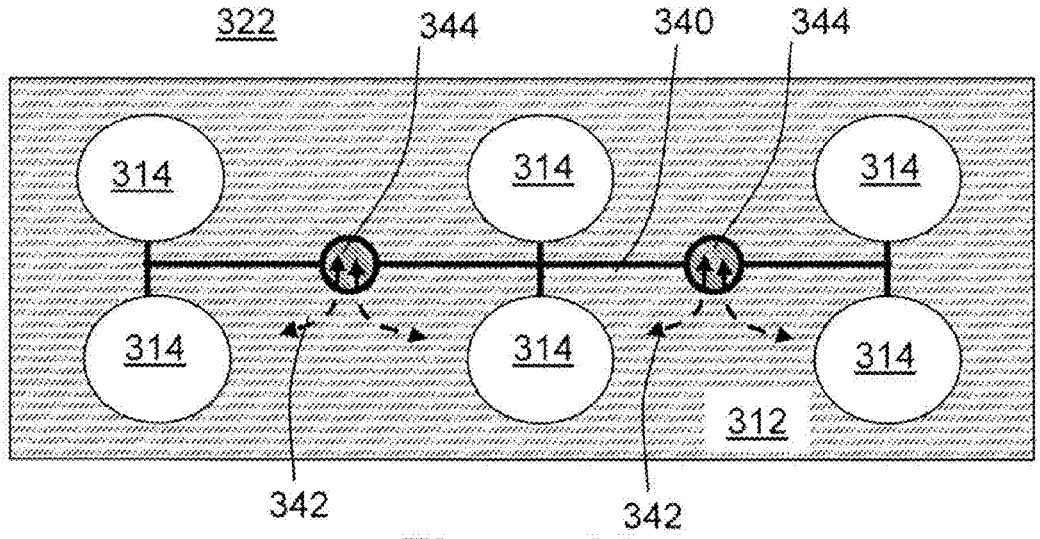
FIG. 26 is a top plan view of an another embodiment of a set of breathable sealed dome switches comprising a plurality of shared vents.

A top planar view of a set of networked sealed dome switch assemblies is shown in FIGS. 25 and 26. In FIG. 25, the vent 340 fluidly connects to the interiors of multiple sealed dome switches and fluidly connects to a single entrance towards the exterior 322. The vent's exterior entrance is covered by a membrane 344. Similarly, in FIG. 26, the vent 340 is used to network multiple dome switch interiors 320 to a plurality of exterior vent entrances. In this embodiment, six dome switches 314 are networked through a vent 304 that has two exterior vent entrances, which are each covered by a membrane 344. A greater number of vent entrances towards the exterior 344 may increase the air flow between the interior space 320 of each sealed dome switch 314 and the exterior 322.

It should be noted that the vent network is not limited to any topology. Topologies for the vent network may include, for example, a star topology, a daisy chain topology, a ring topology and a mesh topology. The number of dome switches and entrances towards the exterior may vary according to the application. Moreover, the placement of the vents is not limited to the dome base 312 or peripheral dome structure 348, and may include for example, external tubing.

The embodiments of sealed dome switch assemblies that have been discussed above are suitable for direct placement on a lower surface such as printed circuit board (PCB). Namely, the entrance of the vent 304 towards the exterior 322 is not placed in a direction facing the bottom surface of the dome switch base 312. Therefore, the above embodiments of sealed dome switches can be placed on a lower surface without having the vent's entrance towards the exterior from being blocked by the lower surface.

As an alternative to the above embodiments, the vent 340 may be a straight channel extending downwardly through the height of the dome base 312, from the bottom surface to the top surface. This may help to avoid the effort of manufacturing a vent 340 which extends along the length of the base 312 and may have one or more turns. However, a vent 340 that extends from the base's 312 bottom to the top must also take into consideration that a lower surface, such as a PCB may be fixed onto the bottom of the dome base 312. This lower surface can block the vent holes and restrict air flow. Therefore, such an embodiment of a breathable sealed dome switch assembly may be supported above the lower surface to allow a vent 340 to fluidly connect the interior space 320 to the dome switch's exterior 322.

Figure 27:
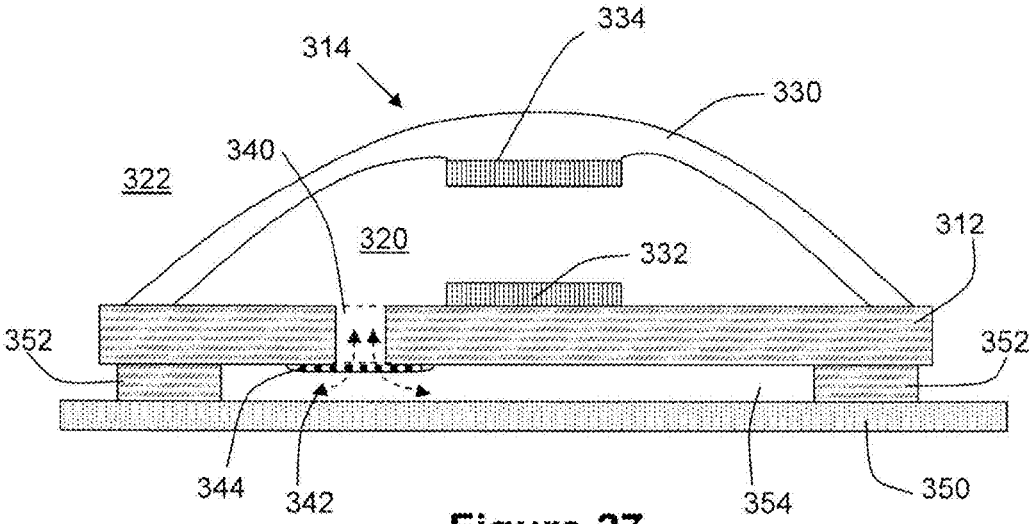
FIG. 27 is a cross-sectional elevation view of an embodiment of a breathable sealed dome switch assembly mounted on another surface.

Turning now to FIG. 27, a vent 340 extends directly through the top and bottom of the dome base 312. The vent 340 is covered by a membrane 344. In other words, the vent 340 extends downwardly through the base 312. One or more support members 352 raise the bottom surface of the dome base 312 and the membrane 344 above a lower surface 350, which allows for air to flow from the dome's interior space 320 to the exterior 322. The support members 352 are also suitable for attaching the sealed dome switch assembly to the lower surface 350, such as a PCB. Other examples of the lower surface 350, comprise a plastic board and a magnesium plate. It should be noted that the cavity 354 between the dome switch base 312 and the lower surface 350, is exposed to the surrounding air and is, therefore, also at ambient air pressure. In this embodiment, no alteration is required to the lower surface 350 to accommodate a vent 340 and corresponding membrane 344.

Alternatively, the breathable sealed dome switch assembly, with a vent 340 extending downwardly through the base 312, may be supported on a lower surface 350 in the configuration where the lower surface 350 comprises a secondary vent aligned with the base's vent 340. This allows the vent to extend directly from the top surface to the bottom surface of the dome base 312. This configuration would also fluidly connect the interior space 320 to the dome switch's exterior.

Figure 28:
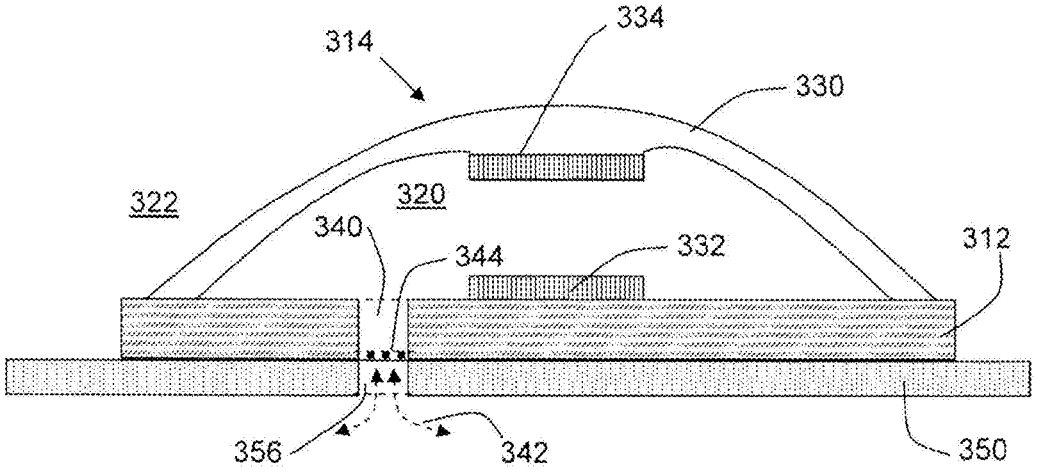
FIG. 28 is a cross-sectional elevation view of an another embodiment of a breathable sealed dome switch assembly mounted on another surface.

Such a configuration is shown in FIG. 28, wherein a vent 340 extends directly between the top and bottom of the dome base 312. In this embodiment, the bottom of the dome base 312 is substantially flush with the lower surface 350. In order for the air 342 to flow from the interior space 320 to the exterior 322, there may be a secondary vent 356 in the lower surface 350 that is generally aligned with the vent 340 in the dome base 312. A membrane 344 covers the vent 340. In the embodiment shown in FIG. 21, the membrane is disposed between the dome base 312 and the lower surface 350. Other variations may include the membrane 344 being disposed towards the bottom of the lower surface 350, covering the secondary vent 356. In yet another variation, there may be multiple vents 340 within the dome base 312 that lead between the exterior 322 and the interior space 320.

In the embodiment shown in FIG. 28, the manufacturing of the dome base 312 affords some simplifications, such as a direct vent 340 and an unmodified dome base 312. However, this embodiment does require modification to the lower surface 350 by the creation of a secondary vent 356.

It will be appreciated that the reference between metal dome 330*a* and dome shell 330 embodiments may be interchangeable where appropriate. Various combinations of the above configurations may be used. By way of example, an array of breathable sealed domes may comprise metal domes 330*a*, adhesive 404 and a dome sheet 400.

It will also be appreciated that the particular embodiments shown in the figures and described above are for illustrative purposes only and many other variations can be used according to the principles described. Although the above has been described with reference to certain specific embodiments, various modifications thereof will be apparent to those skilled in the art as outlined in the appended claims.

The invention claimed is:

1. A breathable sealed dome switch assembly comprising:
a dome switch comprising a shell attached to a base and defining an interior space there between;
at least one vent fluidly connecting said interior space at a first end to an exterior of said assembly at a second end; and
at least one membrane being permeable to air and resistant to contaminants and positioned with said vent such that fluid passing through said vent also passes through said membrane.

2. The breathable sealed dome switch assembly according to claim 1 wherein said shell comprises a resilient material able to collapse and resiliently recover.

3. The breathable sealed dome switch assembly according to claim 1 wherein said vent extends through an interior surface of said shell to an exterior of said shell.

4. The breathable sealed dome switch assembly according to claim 1 wherein said shell further comprises a peripheral structure, said peripheral structure having a greater thickness than said shell.

5. The breathable sealed dome switch assembly according to claim 4 wherein said vent extends through said peripheral structure.

6. The breathable sealed dome switch assembly according to claim 1 wherein said vent extends through said base.

7. The breathable sealed dome switch assembly according to claim 6 wherein said vent extends downwardly through said base.

8. The breathable sealed dome switch assembly according to claim 7 wherein said base is supported above a lower surface.

9. The breathable sealed dome switch assembly according to claim 8 wherein said base further comprises at least one support member to raise said dome base above said lower surface.

10. The breathable sealed dome switch assembly according to claim 7 wherein said base is supported on a lower surface and said lower surface comprises a secondary vent aligned with said vent extending directly from the top surface to the bottom surface of said dome base.

11. The breathable sealed dome switch assembly according to claim 1 comprising a dome sheet and an adhesive, whereby said dome sheet adheres to said shell using said adhesive, and said at least one vent extends through the space defined by at least said adhesive and said dome sheet.

12. The breathable sealed dome switch assembly according to claim 11, wherein said membrane is positioned below said dome sheet and above said base, said membrane held in position by at least said dome sheet.

13. The breathable sealed dome switch assembly according to claim 1, wherein said membrane comprises polytetrafluoroethylene.

* * * * *

UNITED STATES PATENT AND TRADEMARK OFFICE

CERTIFICATE OF CORRECTION

PATENT NO. : 8,178,808 B2
APPLICATION NO. : 12/710457
DATED : May 15, 2012
INVENTOR(S) : Patrick C. Strittmatter et al.

It is certified that error appears in the above-identified patent and that said Letters Patent is hereby corrected as shown below:

On the cover of the patent, item (73), "Assignee: Research in Motion Limited, Waterloo (CA)" should read --Assignee: Research In Motion Limited, Waterloo (CA)--

Signed and Sealed this
Seventh Day of August, 2012

David J. Kappos

David J. Kappos
*Director of the United States Patent and Trademark Office*